US010968911B2

(12) United States Patent
Inada et al.

(10) Patent No.: US 10,968,911 B2
(45) Date of Patent: Apr. 6, 2021

(54) OSCILLATING PISTON-TYPE COMPRESSOR

(71) Applicant: DAIKIN INDUSTRIES, LTD., Osaka (JP)

(72) Inventors: Yukihiro Inada, Osaka (JP); Kazuhiro Furusho, Osaka (JP); Chihiro Endou, Osaka (JP); Takazou Sotojima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 265 days.

(21) Appl. No.: 16/076,870

(22) PCT Filed: Feb. 23, 2017

(86) PCT No.: PCT/JP2017/006906

§ 371 (c)(1),
(2) Date: Aug. 9, 2018

(87) PCT Pub. No.: WO2017/146167

PCT Pub. Date: Aug. 31, 2017

(65) Prior Publication Data

US 2019/0085845 A1 Mar. 21, 2019

(30) Foreign Application Priority Data

Feb. 23, 2016 (JP) ..... JP2016-031643
May 10, 2016 (JP) ..... JP2016-094240

(51) Int. Cl.
*F04C 23/00* (2006.01)
*F04C 18/32* (2006.01)
(Continued)

(52) U.S. Cl.
CPC ..... *F04C 23/001* (2013.01); *F04C 18/322* (2013.01); *F04C 23/008* (2013.01);
(Continued)

(58) Field of Classification Search
CPC ..... F04C 23/001; F04C 23/02; F04C 23/008; F04C 18/04; F04C 18/322; F04C 29/00;
(Continued)

(56) References Cited

U.S. PATENT DOCUMENTS 7,029,252 B2 * 4/2006 Masuda ..... F01C 21/106 418/59
9,261,094 B2 * 2/2016 Hugenroth ..... F01C 21/104
(Continued)

FOREIGN PATENT DOCUMENTS

JP 2004-324652 A 11/2004
JP 2007-239666 A 9/2007
(Continued)

OTHER PUBLICATIONS

European Search Report of corresponding EP Application No. 19 19 8193.5 dated Oct. 16, 2019.
(Continued)

*Primary Examiner* — Charles G Freay
(74) *Attorney, Agent, or Firm* — Global IP Counselors, LLP

(57) ABSTRACT

An oscillating piston compressor includes two oscillating compression units, and an introduction section configured to introduce an intermediate-pressure refrigerant into a compression chamber of each of the compression units. Each compression unit has a cylinder forming a cylinder chamber, a piston housed in the cylinder chamber, and a blade integrally formed with the piston. The piston rotates in the cylinder chamber while the blade oscillates. The two compression units are configured such that phases of the pistons are opposite to each other. The piston has a non-circular outer peripheral surface, and the cylinder chamber has an
(Continued)

inner peripheral surface with a shape determined based on an envelope of the outer peripheral surface of the piston in rotation.

11 Claims, 16 Drawing Sheets

(51) Int. Cl.

| | |
|---|---|
| ***F04C 29/12*** | (2006.01) |
| ***F04C 29/00*** | (2006.01) |
| *F04C 23/02* | (2006.01) |
| *F04C 18/04* | (2006.01) |

(52) U.S. Cl.
CPC ..... *F04C 29/00* (2013.01); *F04C 29/0007* (2013.01); *F04C 29/12* (2013.01); *F04C 18/04* (2013.01); *F04C 23/02* (2013.01); *F04C 2250/20* (2013.01); *F04C 2250/30* (2013.01)

(58) Field of Classification Search
CPC .. F04C 29/0007; F04C 29/12; F04C 2250/20; F04C 2250/30
See application file for complete search history.

(56) References Cited

U.S. PATENT DOCUMENTS

| | | | | |
|---|---|---|---|---|
| 9,322,405 | B2 * | 4/2016 | Ignatiev | F04C 2/46 |
| 2009/0013714 | A1 | 1/2009 | Yamaguchi et al. | |
| 2009/0013715 | A1 * | 1/2009 | Setoguchi | F25B 41/04 62/524 |

FOREIGN PATENT DOCUMENTS

| | | | |
|---|---|---|---|
| JP | 2013-139716 | A | 7/2013 |
| JP | 2013-139725 | A | 7/2013 |

OTHER PUBLICATIONS

International Preliminary Report of corresponding PCT Application No. PCT/JP2017/006906 dated Sep. 7, 2018.
International Search Report of corresponding PCT Application No. PCT/JP2017/006906 dated Apr. 18, 2017.
European Search Report of corresponding EP Application No. 17 75 6605.6 dated Apr. 11, 2019.

* cited by examiner

0° (360°)

90°

180°

270°

0° (360°)

90°

270°

180°

OSCILLATING PISTON-TYPE COMPRESSOR

CROSS-REFERENCE TO RELATED APPLICATIONS

This U.S. National stage application claims priority under 35 U.S.C. § 119(a) to Japanese Patent Application Nos. 2016-031643, filed in Japan on Feb. 23, 2016, and 2016-094240, filed in Japan on May 10, 2016, the entire contents of which are hereby incorporated herein by reference.

BACKGROUND

Field of the Invention

The present disclosure relates to oscillating piston-type compressors.

Background Information

Conventionally, compressors including a compression mechanism of an oscillating piston-type have been known. Japanese Unexamined Patent Publication No. 2007-239666 discloses this type of compressor. This compressor includes an oscillating piston-type f compression mechanism in which a blade oscillates and a circular-shaped piston rotates in a cylinder chamber. When the piston rotates along the inner peripheral surface of the cylinder chamber, the compression mechanism sequentially repeatedly performs a suction stroke during which a fluid is sucked into the cylinder chamber, a compression stroke during which the sucked fluid is compressed, and a discharge stroke during which the compressed fluid is discharged to the outside.

In the compression mechanism of this type, the volume of the compression chamber defined by the piston, the blade, and the cylinder varies significantly, and the pressure in this chamber varies, too. Therefore, when the drive shaft makes one rotation in the compression mechanism, a compression torque varies significantly, resulting in occurrence of vibration and noise.

In the compressor of Japanese Unexamined Patent Publication No. 2007-239666, phases of two pistons are configured to be opposite to each other. Thus, the compression torque of the entire compressor is obtained through synthetization of two types of compression torque whose phases are shifted from each other by approximately 180°. As a result, the compression torque can be smoothed, reducing vibration and noise of the compressor.

SUMMARY

As disclosed in Japanese Unexamined Patent Publication No. 2007-239666, even if the phases of the circular pistons are opposite to each other, its compression torque still varies. Therefore, such variation of the compression torque generates vibration and noise. In particular, under an operating condition where a compression ratio of the compression mechanism is relatively made large, the above-described problem becomes remarkable.

The present disclosure is conceived in view of the above problem, and attempts to provide an oscillating piston-type compressor capable of effectively reducing a range of variation in compression torque.

A first aspect of the present disclosure is directed to an oscillating piston-type compressor including two oscillating-type compression units (41, 51) which each have a cylinder (43, 53) forming a cylinder chamber (60, 70), a piston (45, 55) housed in the cylinder chamber (60, 70), and a blade (46, 56) integrally formed with the piston (45, 55), and in which the piston (45, 55) rotates in the cylinder chamber (60, 70) while the blade (46, 56) oscillates, wherein the two compression units (41, 51) are configured such that phases of the pistons (45, 55) are opposite to each other, the piston (45, 55) has a non-circular outer peripheral surface, whereas the cylinder chamber (60, 70) has an inner peripheral surface of which shape is determined based on an envelope of the outer peripheral surface of the piston (45, 55) in rotation, and the oscillating piston-type compressor further includes an introduction section (67, 68, 163*a*, 164*a*) configured to introduce an intermediate-pressure refrigerant into a compression chamber (75) of each of the compression units (41, 51).

In the first aspect, the outer peripheral surface of the piston (45, 55) is non-circular shaped, and a portion of the outer peripheral surface of the piston (45, 55) adjacent to the bottom dead center can be relatively gently arched. As a result, the volume change rate of the compression chamber (75) when the piston (45, 55) passes through an area near the bottom dead center is smaller than that of a compression chamber in a compression unit having a perfect circle piston (a piston-type of compression unit). In general, the volume change rate of the compression chamber in a circular type of compression unit reaches the maximum value at a rotation angle when a piston passes through an area near the bottom dead center. Using such a non-circular piston (45, 55) can reduce the peak value (the maximum value) of the volume change rate. The compression torque is proportional to the volume change rate of the compression chamber. Thus, reducing the maximum value of the volume change rate in this way can reduce the maximum value of the compression torque.

In addition, in this aspect, the introduction section (67, 68) introduces an intermediate-pressure refrigerant into the compression chamber (75) of the compression unit (41, 5l) in the course of compression. This makes the timing at which the work of compression in the compression chamber (75) earlier than in a case where no intermediate-pressure refrigerant is introduced. As a result, the internal pressure of the compression chamber (75) starts to increase from a relatively large timing. The compression torque is proportional to the internal pressure of the compression chamber (75). Thus, the increase in the internal pressure of the compression chamber (75) like this can reduce the minimum value of the synthesized compression torque.

As can be seen, according to this aspect, the maximum value of the synthesized compression torque is reduced, and the minimum value of the compression torque is increased. As a result, the range of variation in the compression torque is effectively reduced.

A second aspect of the present disclosure is an embodiment of the first aspect. In the second aspect, suppose that a compression stroke in each of the compression units (41, 51) is ended at a rotation angle θ2 under an operating condition where the introduction section (67, 68, 163*a*, 164*a*) introduces no intermediate-pressure refrigerant into the cylinder chamber (60, 70), the outer peripheral surface of the piston (45, 55) is shaped such that a volume change rate of the compression chamber (75) is not decreased in a range from a rotation angle θ1 to the rotation angle θ2, the rotation angle θ1 being smaller than the rotation angle θ2 by a predetermined angle.

According to the second aspect, the outer peripheral surface of each of the pistons (45, 55) is shaped such that a volume change rate of the compression chamber (75) in the compression unit (41, 51) is not decreased in the range from the predetermined rotation angle θ1 to the rotation angle θ2 at which the compression is ended. As a result, the increase in the peak value of the compression torque due to introduction of an intermediate-pressure refrigerant from the introduction section (67, 68) into the compression chamber (75) can be substantially prevented. This will now be described in detail.

For example, suppose that the outer peripheral surface of the piston is shaped such that the volume change rate is lowered in the range from the angle θ1 to θ2, and an intermediate-pressure refrigerant is introduced into the compression chamber. In the compression chamber into which the refrigerant is introduced, the work of compression is started earlier, as described above. This facilitates raising the internal pressure of the compression chamber (75), and the rotation angle at which the internal pressure reaches the maximum value becomes small (early). Therefore, in the configuration in which the volume change rate is downward to the right in the range from the angle θ1 to θ2, the rotation angle at which the internal pressure reaches the maximum value becomes small, and the volume change rate associated with this rotation angle is increased (for example, see FIG. 8, described later, as its detail). As a result, the compression torque associated with this rotation angle is increased, too. In this way, in the configuration in which the volume change rate is downward to the right, introducing an intermediate-pressure refrigerant into the compression chamber (75) causes an increase in the maximum value of the compression torque. This might not sufficiently reduce the range of variation in the compression torque.

In contrast, the piston (45, 55) in this aspect is shaped such that the volume change rate is not decreased in the range from the angle θ1 to θ2. Therefore, even if the intermediate-pressure refrigerant is introduced into the compression chamber (75) and then, the rotation angle at which the internal pressure of the compression chamber (75) reaches the maximum value becomes small, the volume change rate associated with this rotation angle is not increased (for example, see FIG. 10, described later, as its detail). As a result, the increase in the maximum value of the compression torque due to introduction of an intermediate-pressure refrigerant into the compression chamber (75) can be substantially prevented. This can sufficiently reduce the range of variation in the compression torque.

A third aspect of the present disclosure is an embodiment of the second aspect. In the third aspect, the outer peripheral surface of the piston (45, 55) is shaped such that the volume change rate of the compression chamber (75) is increased in the range.

The piston (45, 55) in the third aspect is shaped such that the volume change rate is increased in the range from the angle θ1 to θ2. That is to say, the volume change rate of the compression units (41, 51) is downward to the left in the range from the angle θ1 to θ2. Therefore, if the intermediate-pressure refrigerant is introduced into the compression chamber (75) and then, the rotation angle at which the internal pressure of the compression chamber (75) reaches the maximum value becomes small, the volume change rate associated with this rotation angle is lowered. As a result, the increase in the maximum value of the compression torque due to introduction of an intermediate-pressure refrigerant into the compression chamber (75) can be reliably substantially prevented. This can sufficiently reduce the range of variation in the compression torque.

A fourth aspect of the present disclosure is an embodiment of the second or third aspect. In the fourth aspect, the rotation angle θ1 is 180°.

According to the fourth aspect, the outer peripheral surface of the piston (45, 55) is shaped such that the volume change rate is not lowered in the range from the rotation angle θ1 of 180° to the rotation angle θ2 at which the compression is ended. Therefore, in the range from the rotation angle θ1 to θ2, the volume change rate reaches the maximum value at the rotation angle of 180°. Thus, the volume change rate near the bottom dead center can be lowered, reliably, effectively reducing the maximum value of the compression torque.

A fifth aspect of the present disclosure is an embodiment of any one of the first to fourth aspects. In the fifth aspect, the compression units (41, 51) include a closing member (42, 44, 52) closing an axial opening surface of the cylinder chamber (60, 70), the oscillating piston-type compressor further includes an introduction passage (161) configured to introduce an intermediate-pressure fluid into the cylinder chamber (60, 70), and an opening/closing mechanism (170) configured to open/close the introduction passage (161), wherein the opening/closing mechanism (170) has a valve body (171) driven to open/close the introduction passage (161), and a communication passage (185) applying a predetermined pressure to a back pressure chamber (176) adjacent to a back surface of the valve body (171), and is configured to drive the valve body (171) according to a pressure differential between the introduction passage (161) and the back pressure chamber (176), and the communication passage (185) includes a communication groove (180) in an axial end surface of the cylinder (43, 53) or an axial end surface of the closing member (42, 44, 52) so as to be positioned adjacent to an outer periphery of the cylinder chamber (60, 70).

According to this aspect, at least a part of the communication passage (185) for applying a predetermined pressure to the back pressure chamber (176) includes a communication groove (180) formed in the cylinder (43, 53) or the closing member (42, 44, 52). That is to say, the communication passage (185) can be formed easily only by forming a groove in the axial end surface of the cylinder (43, 53) or the closing member (42, 44, 52), and a predetermined pressure can be applied to the back pressure chamber (176) via the communication groove (180). This simplifies the configuration of the communication passage (185).

A sixth aspect of the present disclosure is an embodiment of the fifth aspect. In the sixth aspect, the communication passage (185) allows the back pressure chamber (176) to communicate with a suction chamber (74) of the cylinder chamber (60, 70).

According to the sixth aspect, the pressure of the suction chamber (74) in the cylinder chamber (60, 70) is applied to the back pressure chamber (176) via the communication passage (185). As a result, the pressure of the back pressure chamber (176) becomes low, and thus, the pressure differential between the introduction passage (161) (intermediate pressure) and the back pressure chamber (176) (low pressure) can be ensured, and the valve body (171) can be driven according to the pressure differential.

A seventh aspect of the present disclosure is an embodiment of the fifth or sixth aspect. In the seventh aspect, the introduction passage (161) and the valve body (171) are disposed inside the closing member (42, 44, 52).

According to the seventh aspect, the introduction passage (161) and the valve body (171) are provided to the interior of the closing member (42, 44, 52). This allows the introduction passage (161) and the valve body (171) not to interfere with the cylinder chamber (60, 70). As a result, the enough space for disposing the introduction passage (161) and the valve body (171) can be provided.

An eighth aspect of the present disclosure is an embodiment of the seventh aspect. In the seventh aspect, the communication groove (180) is formed in an end surface of the closing member (42, 44, 52).

According to the eighth aspect, all of the introduction passage (161), the valve body (171), and the communication groove (180) are collectively arranged in the closing member (42, 44, 52). As a result, the back pressure chamber (176) and the communication groove (180) are completely connected together in the interior of the closing member (42, 44, 52) simplifying the configuration of the opening/closing mechanism (170).

According to the first aspect, the outer peripheral surface of the piston (45, 55) can be gently arched. Thus, the volume change rate when the piston (45, 55) passes through the area near the bottom dead center can be decreased, and then, the maximum value of the compression torque can be reduced. At the same time, introducing the intermediate-pressure refrigerant into the compression chamber (75) can increase the minimum value of the compression torque. As a result, even under a condition where, e.g., the pressure differential in the refrigerant is relatively large, the range of variation in the compression torque can be effectively reduced, and vibration and noise can be reliably reduced.

According to the second aspect, the shape the piston (45, 55) is determined such that the volume change rate is not decreased in the range from the angle θ1 to θ2. Thus, this can substantially prevent the increase in the maximum value of the compression torque due to introducing an intermediate-pressure refrigerant into the compression chamber (75). In particular, according to the third aspect, the volume change rate is increased in the range form the angle θ1 to θ2, reliably preventing the maximum value of the compression torque from increasing too much.

According to the fourth aspect, the rotation angle θ1 is 180°, effectively reducing the maximum value of the compression torque.

According to the fifth aspect, at least a part of the communication passage (185) for applying a predetermined pressure to the back pressure chamber (176) of the valve body (171) is the communication groove (180) formed in the axial end surface of the cylinder (43, 53) or of the closing member (42, 44, 52). Therefore, the groove formation can constitute at least a part of the communication passage (185), simplifying the configuration of the opening/closing mechanism (170), and reducing the cost of manufacturing a rotary compressor.

BRIEF DESCRIPTION OF THE DRAWINGS

FIG. 3A illustrates a state where the rotation angle of a first piston is 0° (360°). FIG. 3B illustrates a state where the rotation angle of the first piston is 90°. FIG. 3C illustrates a state where the rotation angle of the first piston is 180°. FIG. 3D illustrates a state where the rotation angle of the first piston is 270°.

FIG. 4A illustrates a state where the rotation angle of a second piston is 0° (360°). FIG. 4B illustrates a state where the rotation angle of the second piston is 90°. FIG. 4C illustrates a state where the rotation angle of the second piston is 180°. FIG. 4D illustrates a state where the rotation angle of the second piston is 270°.

DETAILED DESCRIPTION OF EMBODIMENT(S)

An embodiment of the present disclosure will now be described in detail with reference to the drawings. The embodiment described below is merely an exemplary one in nature, and is not intended to limit the scope, applications, or use of the disclosure.

Embodiment of Invention

Figure 1:
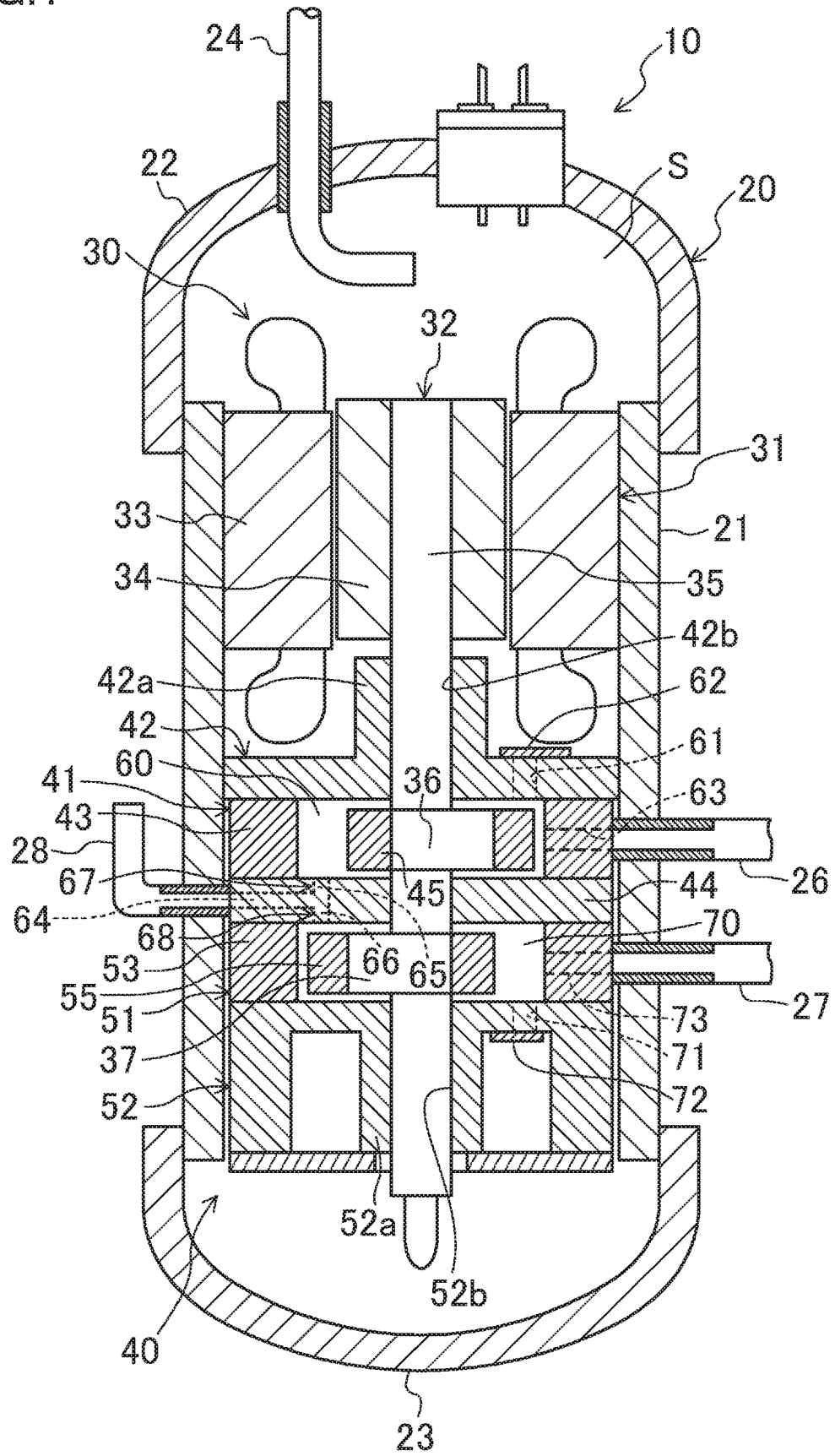
FIG. 1 is a vertical cross-sectional view illustrating an exemplary configuration for an oscillating piston-type compressor according to an embodiment.

FIG. 1 is a schematic vertical cross-sectional view of an oscillating piston-type compressor (10) (hereinafter simply referred to as the compressor (10)) according to the embodiment.

The compressor (10) is connected to, for example, a refrigerant circuit (not shown) of an air conditioner switching between cooling and heating. That is to say, the compressor (10) sucks and compresses the fluid (refrigerant) of the refrigerant circuit, and discharges the compressed refrigerant to the refrigerant circuit. The refrigerant circuit allows a refrigerant to circulate therethrough to perform a refrigeration cycle. Specifically, during a heating operation, the refrigeration cycle is performed in such a manner that a refrigerant compressed by the compressor (10) condenses in an outdoor heat exchanger, and the condensed refrigerant is decompressed at an expansion valve and then evaporates in an indoor heat exchanger. During a heating operation, the refrigeration cycle is performed in such a manner that a refrigerant compressed by the compressor (10) condenses in the indoor heat exchanger, and the condensed refrigerant is decompressed at the expansion valve and then evaporates in the outdoor heat exchanger.

As shown in FIG. 1, the compressor (10) includes a casing (20), a driving mechanism (30), and a compression mechanism (40).

Casing

The casing (20) is a hermetically-sealed container with a vertically oriented cylindrical shape. The casing (20) includes a cylindrically-shaped body (21) standing vertically, an upper end plate (22) closing the upper end of the body (21), and a lower end plate (23) closing the lower end of the body (21).

In the interior of the casing (20), an internal space (S) filled with a high-pressure refrigerant that has been compressed in the compressor (10) is formed. That is to say, the compressor (10) is a so-called high pressure dome-shaped compressor. In the bottom of the casing (20), lubricant oil for lubricating sliding portions is stored.

The casing (20) is connected to one discharge pipe (24), two suction pipes (26, 27), and one introduction pipe (28). The discharge pipe (24) is fixed to the upper end plate (22) while passing through the upper end plate (22). The inlet end of the discharge pipe (24) opens toward the internal space (S). The respective suction pipes (26, 27) are fixed to the body (21) while passing through the lower portion of the body (21). The two suction pipes (26, 27) are configured as an upper, first suction pipe (26) and a lower, second suction pipe (27). The introduction pipe (28) is fixed to the body (21) while passing through the lower portion of the body (21).

Driving Mechanism

The driving mechanism (30) constitutes a driving source of the compression mechanism (40). The driving mechanism (30) includes an electric motor (31) and a drive shaft (32).

Electric Motor

The electric motor (31) includes a stator (33) and a rotor (34). The stator (33) is cylindrically-shaped, and is fixed to the body (21) of the casing (20). The rotor (34) is cylindrically-shaped, and penetrates the interior of the stator (33).

Power is supplied to the electric motor (31) through an inverter. That is to say, the electric motor (31) is configured as an inverter electric motor of which the number of rotation is variable.

Drive Shaft

The drive shaft (32) includes a main shaft (35) and two eccentric portions (36, 37). The main shaft (35) is cylindrically shaped so as to extend vertically from the electric motor (31) toward the lower portion of the compression mechanism (40). The rotor (34) of the electric motor (31) is fixed to the upper portion of the main shaft (36).

The two eccentric portions (36, 37) are integrally formed with each other and cylindrically shaped in the lower portion of the main shaft (35). The eccentric portions (36, 37) may be the same member as the main shaft (35) or may be a separate member from the member of the main shaft (35). The outer diameter of each eccentric portion (36, 37) is larger than that of the main shaft portion (35). The axial center of each eccentric portion (36, 37) is shifted from that of the main shaft part (35) by a predetermined amount.

Two eccentric portions (36, 37) are configured as an upper, first eccentric portion (36) and a lower, second eccentric portion (37). The axial center of the first eccentric portion (36) and the axial center of the second eccentric portion (37) are shifted from each other by 180° with respect to the axial center of the main shaft (35). That is to say, the first eccentric portion (36) and the second eccentric portion (37) are coupled to the main shaft (35) such that the rotation angle phases thereof are opposite to each other.

Compression Mechanism

Figure 2:
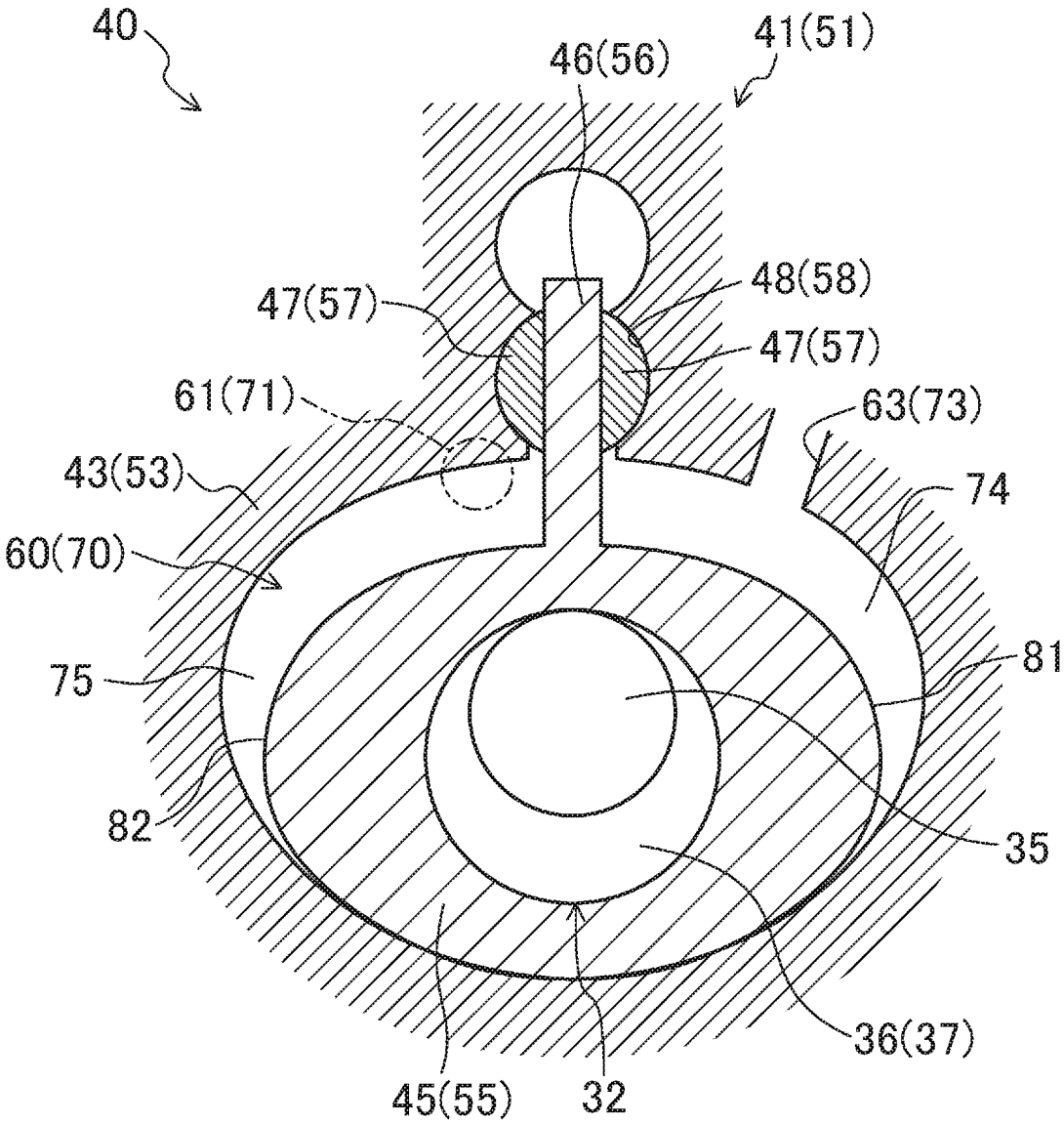
FIG. 2 is a horizontal cross-sectional view of a compression mechanism.

The configuration of the compression mechanism (40) will be described in detail below with reference to FIGS. 1 to 4. FIG. 2 is a horizontal cross-sectional view of the compression mechanism (40).

The compression mechanism (40) is driven by the driving mechanism (30), and compresses a fluid. The compression mechanism (40) includes a first compression unit (41) and a second compression unit (51). In the first compression unit (41) and the second compression unit (51), a low pressure refrigerant in the refrigerant circuit is compressed to be at a high level.

As shown in FIG. 1, the compression mechanism (40) is provided with a front head (42), a first cylinder (43), a middle plate (44), a second cylinder (53), and a rear head (52) sequentially arranged from the upper portion to the lower portion of thereof. The first compression unit (41) and the second compression unit (51) share the middle plate (44).

First Compression Unit

The first compression unit (41) is provided with the upper portion of the compression mechanism (40). The first compression unit (41) includes the front head (42), the first cylinder (43), the middle plate (44), a first piston (45), a first blade (46), and a first bush (47).

Front Head

The front head (42) is fixed to the body (21) of the casing (20). The center of the front head (42) is provided with a boss (42*a*) extending upward in the axial direction of the drive shaft (32). The inner peripheral surface of the boss (42*a*) of the front head (42) is provided with a main bearing (42*b*) enabling the drive shaft (32) to rotate.

The front head (42) is provided with a first discharge port (61). The first discharge port (61) axially passes through the body of the front head (42). The first discharge port (61) has its starting end communicating with a compression chamber (75) of a first cylinder chamber (60), and its terminal end communicating with the internal space (S). The first discharge port (61) is provided with a first discharge valve (62) opening/closing the first discharge port (61). The first discharge valve (62), if the internal pressure in the compression chamber (75) of the first cylinder chamber (60) reaches a predetermined value or more, opens the first discharge port (61).

First Cylinder

The first cylinder (43) is fixed to the body (21) of the casing (20). In the interior of the first cylinder (43), the first cylinder chamber (60) is formed. The first cylinder chamber (60) has its upper end closed by the front head (42), and its lower end closed by the middle plate (44). The specific shape of the inner peripheral surface of the first cylinder chamber (60) will be described later.

A first bush hole (48) is formed in the first cylinder (43) at a position adjacent to a top dead center. The first bush hole (48) is substantially cylindrically shaped so as to pass through the first cylinder (43) in the axial direction of the drive shaft (32). The first hush hole (48) communicates with the first cylinder chamber (60).

A first suction port (63) is formed in the first cylinder (43) at a position adjacent to a suction chamber (74) of the first cylinder chamber (60). The first suction port (63) radially passes through the first cylinder (43). The first suction port (63) has its starting end communicating with the first suction pipe (26), and its terminal end communicating with the suction chamber (74) of the first cylinder chamber (60).

Middle Plate

The middle plate (44) is fixed to the body (21) of the casing (20). The middle plate (44) is substantially annually shaped, through which the drive shaft (32) passes.

The middle plate (44) includes a transfer passage (64), a first introduction port (65), and a second introduction port (66). The transfer passage (64) extends radially in the interior of the middle plate (44). The transfer passage (64) has its starting end connected to the introduction pipe (28). The transfer passage (64) has its terminal end disposed in the intermediate portion of the middle plate (44) in its radial direction.

The first introduction port (65) extends axially upward from the terminal end of the transfer passage (64). The first introduction port (65) has its starting; end communicating with the transfer passage (64), and its terminal end communicating with the compression chamber (75) of the first cylinder chamber (60). The second introduction port (66) extends axially upward from the terminal end of the transfer passage (64). The second introduction port (66) has its starting end communicating with the transfer passage (64), and its terminal end communicating with a compression chamber (75) of a second cylinder chamber (70).

The introduction pipe (28), the transfer passage (64), and the first introduction port (65) constitute a first introduction section (67) supplying the compression chamber (75) of the first compression unit (41) with an intermediate-pressure refrigerant. The introduction pipe (28), the transfer passage (64), and the second introduction port (66) constitute a second introduction section (68) supplying the compression chamber (75) of the second compression unit (51) with an intermediate-pressure refrigerant. Here, the intermediate-pressure refrigerant is a refrigerant with a predetermined pressure between a high pressure (corresponding to the condensing pressure) and a low pressure (corresponding to the evaporating pressure) in the refrigerant circuit.

The first introduction section (67) and the second introduction section (68) in this embodiment share the introduction pipe (28) and the transfer passage (64). Alternatively, the first introduction section (67) may be provided with an introduction pipe (28) and a transfer passage (64), and the second introduction section (68) may be provided with another introduction pipe (28) and another transfer passage (64).

First Piston

The first piston (45) is disposed in the first cylinder chamber (60) and rotates along the inner peripheral surface of the first cylinder chamber (60). The first piston (45) is substantially annually shaped, into which the first eccentric portion (36) is fitted. The specific shape of the outer peripheral surface of the first piston (45) will be described later.

First Blade

The first blade (46) is integrally formed with the first piston (45). The first blade (46) is coupled to the outer peripheral surface of the first piston (45) at a position adjacent to the first bush hole (48) (adjacent to the top dead center). The first blade (46) is plate-shaped so as to protrude, from the outer peripheral surface of the first piston (45), radially outward of the first cylinder chamber (60). The first blade (46) divides the first cylinder chamber (60) into the suction chamber (74) and the compression chamber (75). The first blade (46) is configured to vibrate in a situation where the first piston (45) rotates.

First Bush

A pair of first bushes (47) is inserted into the first bush hole (48). The pair of first bushes (47) has substantially a semi-circular-shaped cross section perpendicular to the axis, and inserted into the interior of the first hush hole (48).

The pair of first bushes (47) is arranged such that the respective flat surfaces thereof face each other. The first blade (46) is inserted between these flat faces so as to be movable back and forth. That is to say, the first bush (47) vibrates inside the first bush hole (48) while keeping the first blade (46) movable back and forth.

Second Compression Unit

The second compression unit (51) is disposed in the lower portion of the compression mechanism (40). The second compression unit (51) includes the middle plate (44), the rear head (52), the second cylinder (53), a second piston (55), a second blade (56), and a second bush (57).

Rear Head

The rear head (52) is fixed to the body (21) of the casing (20). The center of the rear head (52) is provided with a boss (52*a*) extending downward in the axial direction of the drive shaft (32). The inner peripheral surface of the boss (52*a*) of the rear head (52) is provided with a sub hearing (52*b*) enabling the drive shaft (32) to rotate.

The rear head (52) is provided with a second discharge port (71). The second discharge port (71) axially passes through the body of the rear head (52). The second discharge port (71) has its starting end communicating with the compression chamber (75) of the second cylinder chamber (70), and its terminal end communicating with the internal space (S). The second discharge port (71) is provided with a second discharge valve (72) opening/closing the second discharge port (71). The second discharge valve (72), if the internal pressure in the compression chamber (75) of the second cylinder chamber (70) reaches a predetermined value or more, opens the second discharge port (71).

Second Cylinder

The second cylinder (53) has the same basic configuration as the first cylinder (43). The second cylinder (53) is fixed to the body (21) of the casing (20). In the interior of the second cylinder (53), the second cylinder chamber (70) is formed. The second cylinder chamber (70) has its upper end closed by the middle plate (44), and its lower end closed by the rear head (52). The specific shape of the inner peripheral surface of the second cylinder chamber (70) will be described later.

A second bush hole (58) is formed in the second cylinder (53) at a position adjacent to a top dead center. The second bush hole (58) is substantially cylindrically shaped so as to pass through the second cylinder (53) in the axial direction of the drive shaft (32). The second bush hole (58) communicates with the second cylinder chamber (70).

A second suction port (73) is formed in the second cylinder (53) at a position adjacent to a suction chamber (74) of the second cylinder chamber (70). The second suction port (73) radially passes through the second cylinder (53). The second suction port (73) has its starting end communicating with a second suction pipe (27), and its terminal end communicating with the suction chamber (74) of the second cylinder chamber (70).

Second Piston

The second piston (55) has the same basic configuration as the first piston (45). The second piston (55) is disposed in the second cylinder chamber (70) and rotates along the inner peripheral surface of the second cylinder chamber (70). The second piston (55) is substantially annually shaped, into which the second eccentric portion (37) is fitted. The specific shape of the outer peripheral surface of the second piston (55) will be described later.

The rotation angle phase of the second piston (55) is opposite to that of the first piston (45). That is to say, the rotation angle of the first piston (45) and the rotation angle of the second piston (55) are shifted from each other by about 180°.

Second Blade

The second blade (56) has the same basic configuration as the first blade (46). The second blade (56) is integrally formed with the second piston (55). The second blade (56) is coupled to the outer peripheral surface of the second piston (55) at a position adjacent to the second bush hole (58) (adjacent to the top dead center). The second blade (56) is plate-shaped so as to protrude, from the outer peripheral surface of the second piston (55), radially outward of the second cylinder chamber (70). The second blade (56) divides the second cylinder chamber (70) into the suction chamber (74) and the compression chamber (75). The second blade (56) is configured to vibrate in a situation where the second piston (55) rotates.

Second Bush

The second bush (57) has the same basic configuration as the first bush (47). A pair of second bushes (57) is inserted into the second bush hole (58). The pair of second bushes (57) has substantially a semi-circular-shaped cross section perpendicular to the drive shaft (32), and inserted into the interior of the second bush hole (58).

The pair of second bushes (57) is arranged such that the respective faces thereof face each other. The second blade (56) is inserted between these flat faces so as to be movable back and forth. That is to say, the second bush (57) vibrates inside the second bush hole (58) while keeping the second blade (56) movable back and forth.

Operation

A basic operation of the compressor (10) will be described with reference to FIGS. 1 to 4.

When the electric motor (31) is caused to conduct, the rotator (34) rotates. Along with this, the drive shaft (32), the eccentric portions (36, 37), and the pistons (45, 55) rotate. As a result, the refrigerant is compressed in the first compression unit (41) and the second compression unit (51) to perform the refrigeration cycle in the refrigerant circuit. That is to say, low pressure refrigerants in the refrigerant circuit flow, in parallel with each other, in the first suction pipe (26) and the second suction pipe (27). The refrigerant from the first suction pipe (26) and the refrigerant from the second suction pipe (27) are respectively compressed in the first compression unit (41) and the second compression unit (51). The refrigerants (high pressure refrigerants) that have been compressed in the respective compression units (41, 51) flow out into the internal space (S), and are discharged in the refrigerant circuit through the discharge pipe (24).

Operation of First Compression Unit

In the first compression unit (41), the suction stroke, a compression stroke, and a discharge stroke are sequentially repeated.

Figure 3A:
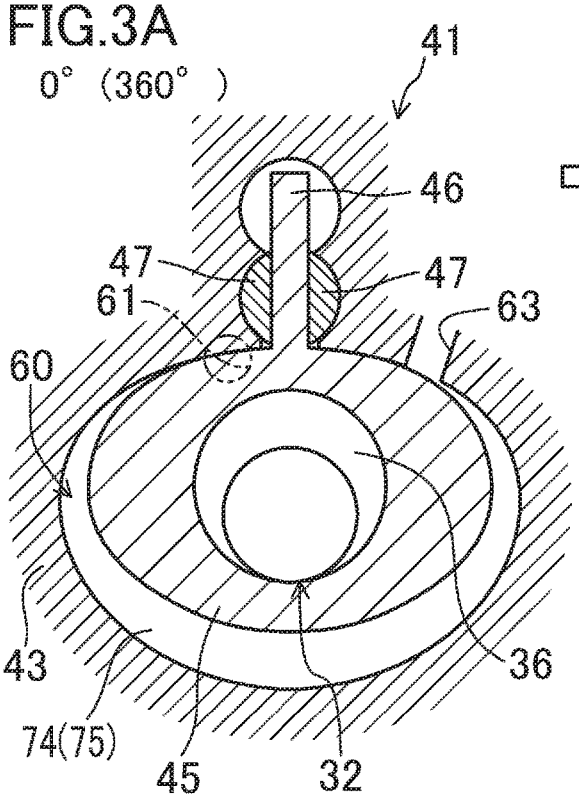
FIGS. 3A to 3D illustrate the operation of a first compression unit, and correspond to FIG. 2.
Figure 3B:
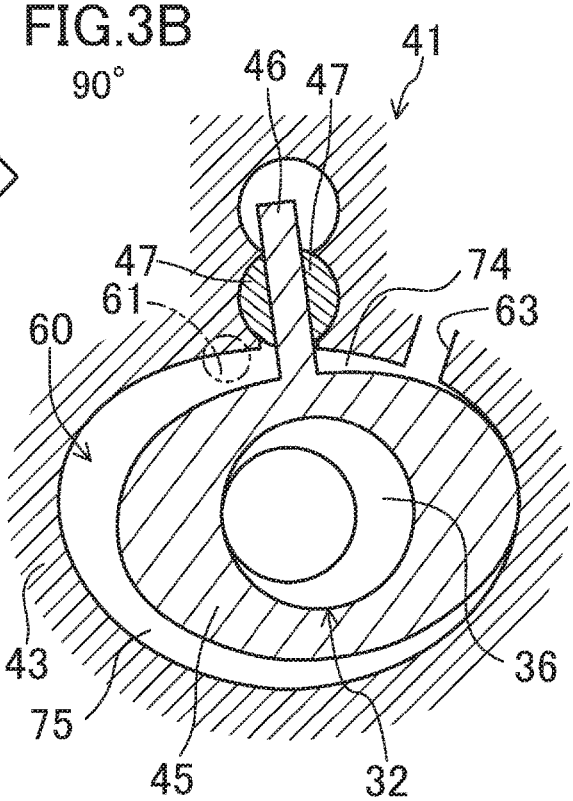
Figure 3C:
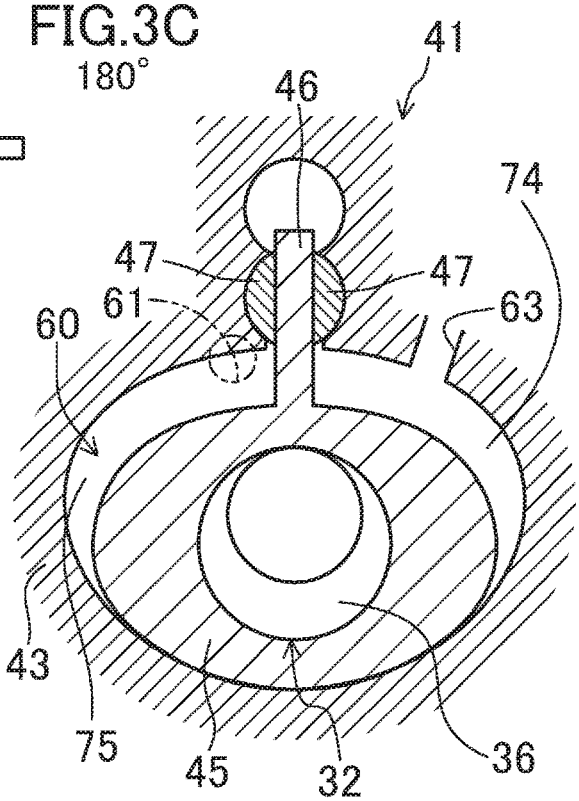
Figure 3D:
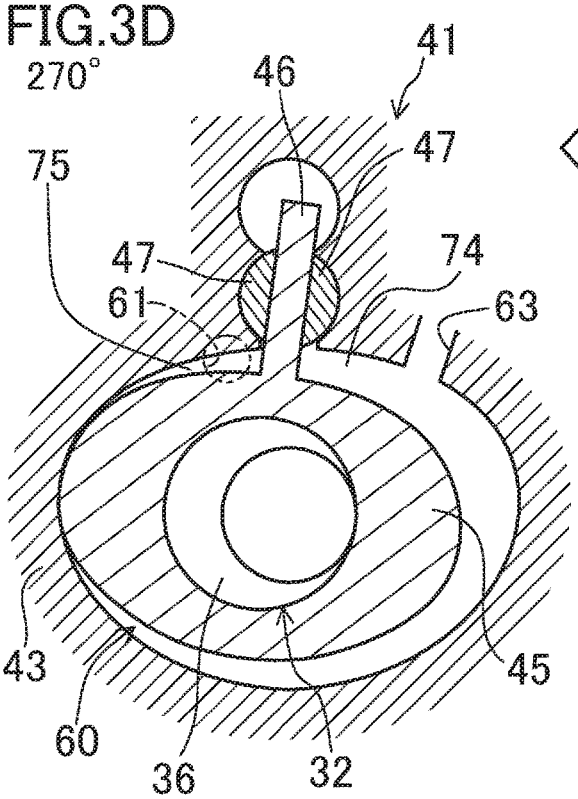

If the first piston (45) shown in FIG. 3B rotates as sequentially shown in shown in FIGS. 3C, 3D, and 3A, the volume of the suction chamber (74) is gradually increased, and the low pressure refrigerant is gradually sucked into the suction chamber (74) (the suction stroke). This suction stroke is performed until just before a sealing point between the first piston (45) and the first cylinder chamber (60) completely passes through the first suction port (63).

After the sealing point passes through the first suction port (63), the space that has been the suction chamber (74) is turned to be the compression chamber (75). If the first piston (45) shown in FIG. 3A rotates as sequentially shown in shown in FIGS. 3B and 3C, the volume of the compression chamber (75) is gradually decreased, and the refrigerant is compressed in the compression chamber (75) (the compression stroke). If the internal pressure in the compression chamber (75) reaches a predetermined value or more, the first discharge valve (62) is opened, and the refrigerant in the compression chamber (75) is discharged into the internal space (S) through the first discharge port (61) (discharge stroke).

Operation of Second Compression Unit

In the second compression unit (51), the suction stroke, the compression stroke, and the discharge stroke are sequentially repeated. The second piston (55) having a phase shifted from the phase of the first piston (45) by 180° rotates the second cylinder chamber (70).

Figure 4A:
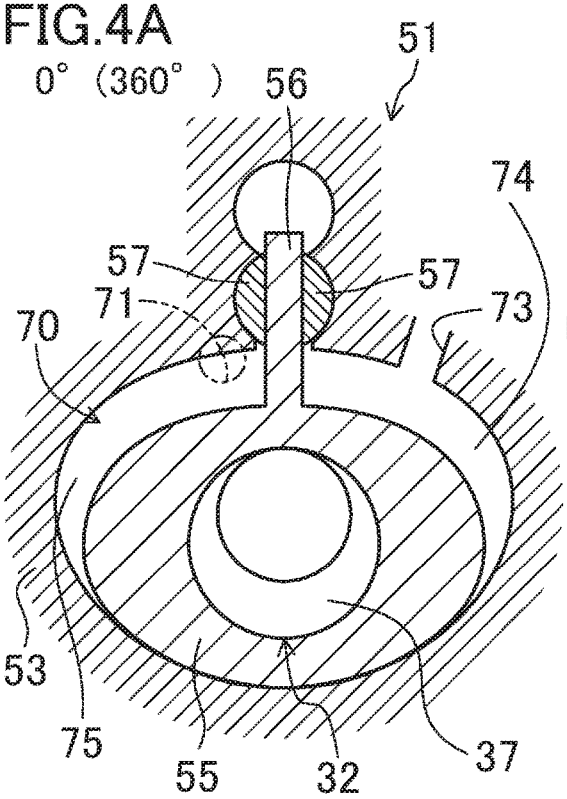
FIGS. 4A to 4D illustrate the operation of a second compression unit, and correspond to FIG. 2.
Figure 4B:
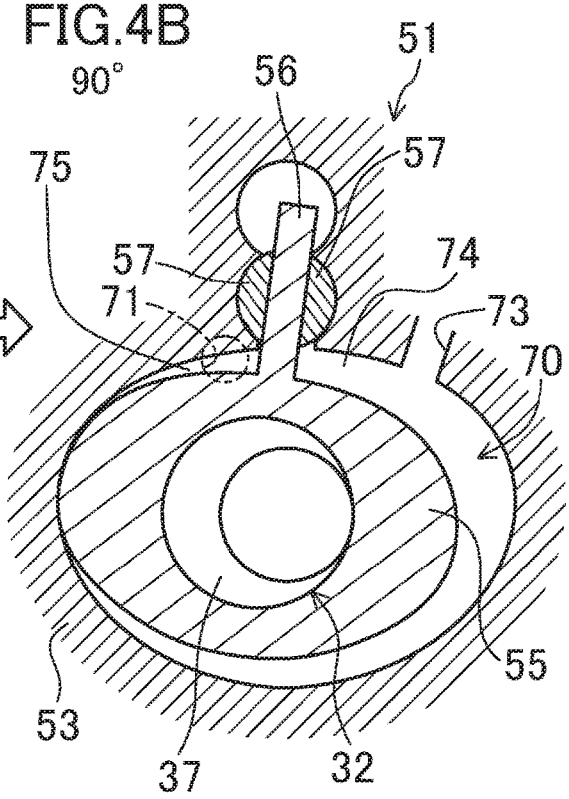
Figure 4D:
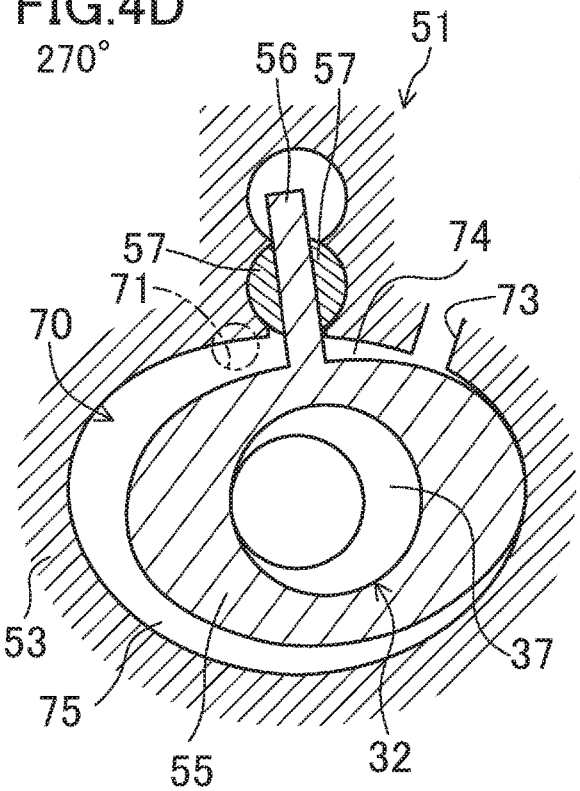
Figure 4C:
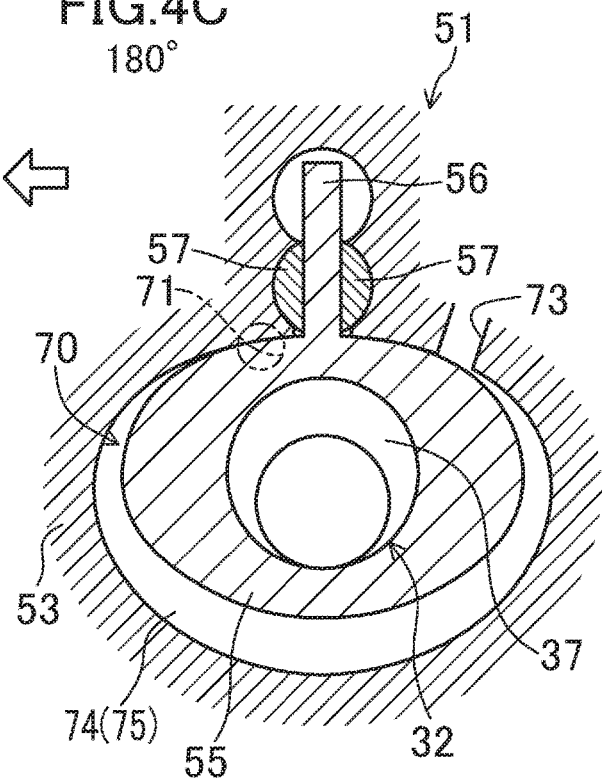

If the second piston (55) shown in FIG. 4D rotates as sequentially shown in FIGS. 4A, 4B, and 4C, the volume of the suction chamber (74) is gradually increased, and the low pressure refrigerant is gradually sucked into the suction chamber (74) (the suction stroke). This suction stroke is performed until just before a sealing point between the second piston (55) and the second cylinder chamber (70) completely passes through the second suction port (73).

After the sealing point passes through the second suction port (63), the space that has been the suction chamber (74) is turned to be the compression chamber (75). If the second piston (45) shown in FIG. 4C rotates as sequentially shown in FIGS. 4D and 4A, the volume of the compression chamber (75) is gradually decreased, and the refrigerant is compressed in the compression chamber (75) (the compression stroke). If the internal pressure in the compression chamber (75) reaches a predetermined value or more, the second discharge valve (72) is opened, and the refrigerant in the compression chamber (75) is discharged into the internal space (S) through the second discharge port (71) (discharge stroke).

Injection Operation

If the air conditioner is operated at a high load or the pressure differential in the refrigeration cycle is relatively large, an operation in which an intermediate-pressure refrigerant is introduced from the introduction sections (67, 68) into the respective cylinder chambers (60, 70) (also called as "the injection operation") is performed.

The first introduction section (67) introduces an intermediate-pressure refrigerant into the compression chamber (75) of the first cylinder chamber (60). Specifically, the intermediate-pressure refrigerant flowing in the introduction pipe (28) passes through the transfer passage (64) and the first introduction port (65) to be introduced into the compression chamber (75) of the first cylinder chamber (60). As a result, in the compression chamber (75) of the first cylinder chamber (60), the work of compression is done at a slightly earlier phase than in a case where no intermediate-pressure refrigerant is introduced.

The second introduction section (68) introduces an intermediate-pressure refrigerant into the compression chamber (75) of the second cylinder chamber (70). Specifically, the intermediate-pressure refrigerant flowing in the introduction pipe (28) passes through the transfer passage (64) and the second introduction port (66) to be introduced into the compression chamber (75) of the second cylinder chamber (70). As a result, in the compression chamber (75) of the second cylinder chamber (70), the work of compression is done at a slightly earlier phase than in a case where no intermediate-pressure refrigerant is introduced.

Timing of End of Compression Stroke and Start of Discharge Stroke

Under an operating condition where an intermediate-pressure refrigerant is introduced at a relatively high load, in each compression unit (41, 51), the compression stroke is ended and at the same time, the discharge stroke is started when each piston (45, 55) has a rotation angle θ2 that is more than 180°. This rotation angle θ2 varies depending on operating conditions. If no intermediate-pressure refrigerant is introduced from the introduction sections (67, 68) to the cylinder chambers (60, 70), the angle θ2 can vary within a range of, e.g., $180° < \theta 2 < 250°$.

Specific Shape of Outer Peripheral Surface of Piston

Specific shapes of the pistons (45, 55) will be described with reference to FIGS. 2 and 5.

The outer peripheral surface of each piston (45, 55) has a substantially elliptical shape or a substantially oval shape in which its vertical length in FIG. 2 is shorter than its longitudinal length. Each piston (45, 55) has a first bulge (81) bulging toward the suction side (the right side in FIG. 2) with respect to the base of each blade (46, 56), and a second bulge (82) bulging toward the discharge side (the left side in FIG. 2) with respect to the base of each blade (46, 56). The outer peripheral surface of each piston (45, 55) includes an arcuate surface at a position adjacent to the bottom dead center, the arcuate surface being gentler than the other portions.

The outer peripheral surface of each piston (45, 55) will be described in more detail with reference to FIG. 5.

The outer peripheral surface of each piston (45, 55) includes a suction-side arcuate surface (C0), a first arcuate surface (C1), a second arcuate surface (C2), a third arcuate surface (C3), a fourth arcuate surface (C4), a fifth arcuate surface (C5), and a discharge-side arcuate surface (C6) which are sequentially arranged in the clockwise direction from the base of the blade (46, 56). That is to say, each piston (45, 55) is comprised of these arcuate surfaces (C0 to C6) continuously disposed in the circumferential direction. These arcuate surfaces (C0 to C6) respectively have certain curvature radii (R0 to R6) and centers (M0 to M6) so as to be smoothly continuous with one another.

Suction-Side Arcuate Surface

The suction-side arcuate surface (C0) is formed within a predetermined range in the clockwise direction (hereinafter also referred to as a normal direction of rotation) from the base of the suction side of the blade (46, 56). The center (M0) of the suction-side arcuate surface (C0) is disposed on the intermediate line in the width direction of the blade (46, 56) (the left-and-right direction in FIG. 5) at a predetermined position on an opposite side of the drive shaft (32) from the blade (46, 56). A sealing point is formed between the suction-side arcuate surface (C0) and the cylinder (43, 53) when the piston (45, 55) has a rotation angle of about 0° to about 15°.

First Arcuate Surface

The first arcuate surface (C1) is continuously formed between the suction-side arcuate surface (C0) and the second arcuate surface (C2). The center (M1) of the first arcuate surface (C1) is positioned on an imaginary line passing through the center (M0) of the suction-side arcuate surface (C0) and an end of the suction-side arcuate surface (C0) adjacent to the first arcuate surface (C1) in the normal direction of rotation. A sealing point is formed between the first arcuate surface (C1) and the cylinder (43, 53) when the piston (45, 55) has a rotation angle of about 15° to about 60°.

Second Arcuate Surface

The second arcuate surface (C2) is continuously formed between the first arcuate surface (C1) and the third arcuate surface (C3). The second arcuate surface (C2) includes a portion in which the piston (45, 55) having a rotation angle of 90° forms a sealing point together with the cylinder (43, 53) (a substantially contact portion through an oil film). The center (M2) of the second arcuate surface (C2) is positioned on an imaginary line passing through the center (M1) of the first arcuate surface (C1) and an end of the first arcuate surface (C) adjacent so the second arcuate surface (C2) in the normal direction of rotation. A sealing point is formed between the second arcuate surface (C2) and the cylinder (43, 53) when the piston (45, 55) has a rotation angle of about 60° to about 140°.

Third Arcuate Surface

The third arcuate surface (C3) is continuously formed between the second arcuate surface (C2) and the fourth arcuate surface (C4). The second arcuate surface (C2) includes a portion in which the piston (45, 55) having a rotation angle of 180° (in the state of the bottom dead center) forms a sealing point together with the cylinder (43, 53) (a substantially contact portion through an oil film). The (M3) of the third arcuate surface (C3) is positioned on an imaginary line passing through the center (M2) of the second arcuate surface (C2) and an end of the second arcuate surface (C2) adjacent to the third arcuate surface (C3) in the normal direction of rotation. A sealing point is formed between the third arcuate surface (C3) and the cylinder (43, 53) when the piston (45, 55) has a rotation angle of about 140° to about 220°. A sealing point is formed between the third arcuate surface (C3) and the cylinder (43, 53) when the adjacent compression chamber (75) is in the course of the discharge stroke.

Fourth Arcuate Surface

The fourth arcuate surface (C4) is continuously formed between the third arcuate surface (C3) and the fifth arcuate surface (C5). The fourth arcuate surface (C4) includes a portion in which the piston (45, 55) having a rotation angle of 270° forms a sealing point together with the cylinder (43, 53) (a substantially contact portion through an oil film). The center (M4) of the fourth arcuate surface (C4) is positioned on an imaginary line passing through the center (M3) of the third arcuate surface (C3) and an end of the third arcuate surface (C3) adjacent to the fourth arcuate surface (C4) in the normal direction of rotation. A sealing point is formed between the fourth arcuate surface (C4) and the cylinder (43, 53) when the piston (45, 55) has a rotation angle of about 220° to about 300°.

Fifth Arcuate Surface

The fifth arcuate surface (C5) is continuously formed between the fourth arcuate surface (C4) and the discharge-side arcuate surface (C6). The center (M5) of the fifth arcuate surface (C5) is positioned on an imaginary line passing through the center (M4) of the fourth arcuate surface (C4) and an end of the fourth arcuate surface (C4) adjacent to the fifth arcuate surface (C5) in the normal direction of rotation. A sealing point is formed between the fifth arcuate surface (C5) and the cylinder (43, 53) when the piston (45, 55) has a rotation angle of about 300° to about 345°.

Discharge-Side Arcuate Surface

The discharge-side arcuate surface (C6) is formed within a predetermined range in the counter-clockwise direction (hereinafter also referred to as a normal direction of rotation) from the base of the discharge side of the blade (46, 56). The center (C6) of the discharge-side arcuate surface (C6) is consistent with the center (M0) of the suction-side arcuate surface (C0). A sealing point is formed between the discharge-side arcuate surface (C6) and the cylinder (43, 53) when the piston (45, 55) has a rotation angle of about 345° to about 360°.

Relationship Among Curvature Radii

The relationship among the curvature radii of the arcuate surfaces (C0 to C6) will be described.

The curvature radius (R3) of the third arcuate surface (C3) is larger than the curvature radius (R1) of the first arcuate surface (C1) and than the curvature radius (R5) of the fifth arcuate surface (C5). The curvature radius (R1) of the first arcuate surface (C1) and the curvature radius (R5) of the fifth arcuate surface (C5) are larger than the curvature radius (R2) of the second arcuate surface (C2) and than the curvature radius (R4) of the fourth arcuate surface (C4). The curvature radius (R1) of the first arcuate surface (C1) is equal to the curvature radius (R5) of the fifth arcuate surface (C5). The curvature radius (R2) of the second arcuate surface (C2) is equal to the curvature radius (R4) of the fourth arcuate surface (C4).

The curvature radius (R0) of the suction-side arcuate surface (C0) and the curvature radius (R6) of the discharge-side arcuate surface (C6) are larger than the curvature radius (R3) of the third arcuate surface (C3). The curvature radius (R0) of the suction-side arcuate surface (C0) is equal to the curvature radius (R6) of the discharge-side arcuate surface (C6).

Shape of Inner Peripheral Surface of Second Cylinder

As shown in FIG. 2, the shape of the inner peripheral surface of each cylinder (43, 53) is associated with that of the outer peripheral surface of each piston (45, 55). That is to say, the shape of the inner peripheral surface of each cylinder (43, 53) is determined based on the envelope of each piston (45, 55) in rotation. The inner peripheral surface of each cylinder (43, 53) has an elliptical shape or a substantially oval shape in which its vertical length in FIG. 2 is shorter than its longitudinal length.

Features of Volume Change Rate of Compression Chamber

In the compressor (10) according to this embodiment, the shape of each piston (45, 55) is determined so as to obtain the following feature (profile) of a volume change rate.

Figure 6:
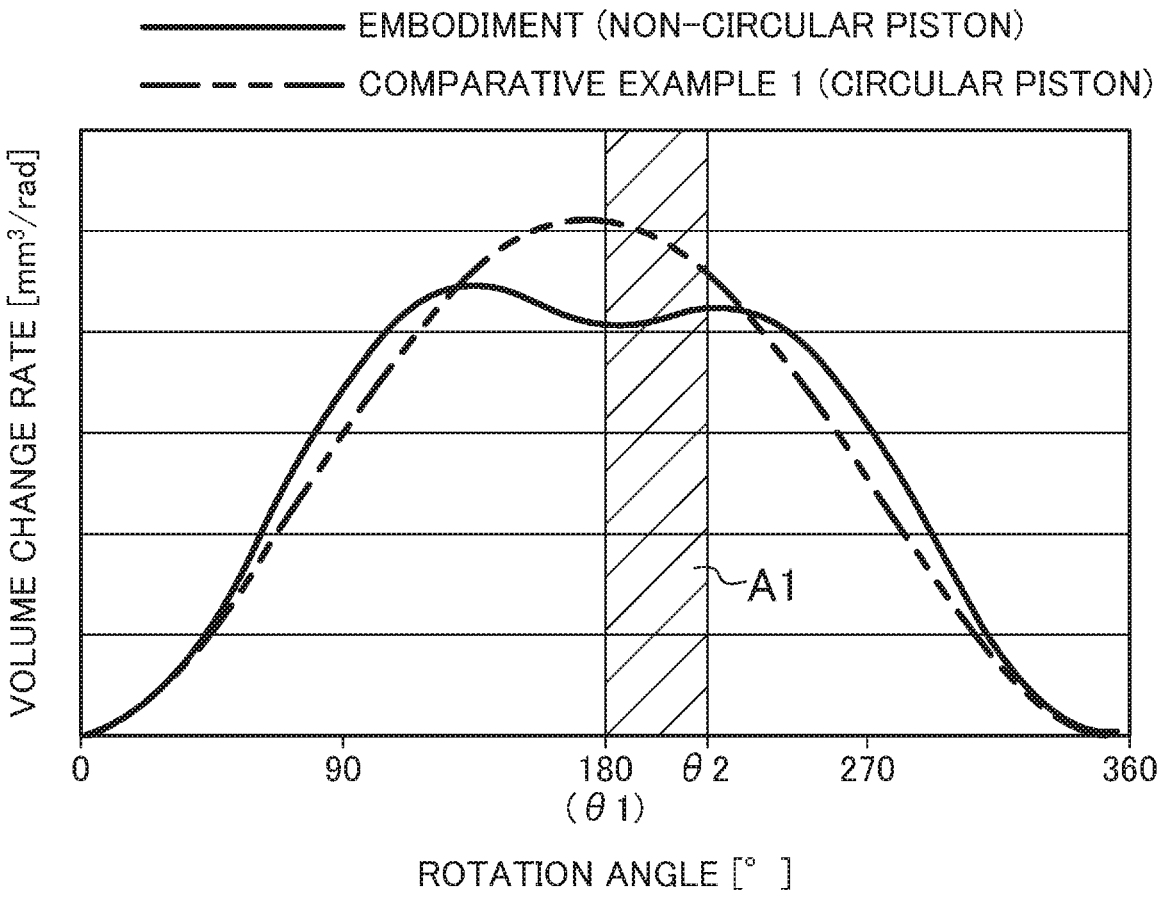
FIG. 6 is a graph making a comparison between the embodiment and a comparative example 1 regarding the relationship between the rotation angle of the piston and a volume change rate.

FIG. 6 shows a rate of change in the volume of one compression chamber (75) [$mm^3$/rad] per rotation of the piston (45, 55). In FIG. 6, the solid line indicates the embodiment, and the broken line indicates a comparative example 1 (a well-known compressor having a circular piston).

The volume change rate in the embodiment is "rather mildly" changed in a range in which the first arcuate surface (C1) and the cylinder (43, 53) are in contact with each other, "rather steeply" changed in a range in which the second arcuate surface (C2) and the cylinder (43, 53) are in contact with each other, "mildly" changed in a range in which the third arcuate surface (C3) and the cylinder (43, 53) are in contact with each other, "rather steeply" changed in a range in which the fourth arcuate surface (C4) and the cylinder (43, 53) are in contact with each other, and "rather mildly" changed in a range in which the fifth arcuate surface (C5) and the cylinder (43, 53) are in contact with each other.

The shape of the outer peripheral surface of the piston (45, 55) is formed such that the volume change rate is not lowered in a range from the predetermined rotation angle θ1 of the piston (45, 55) to the rotation angle θ2 at which the compression stroke is ended (the hatched region A1 in FIG. 6). The rotation angle θ2 at which the compression stroke is ended is a rotation angle at which the compression stroke is ended under the operating condition where the load is relatively high and no intermediate-pressure refrigerant is introduced from the introduction sections (67, 68) to the compression chamber (75). In the example of FIG. 6, θ1 is about 180° and θ2 is about 215°. θ1 may be other than 180° as long as it is smaller than θ2 by a predetermined rotation angle. θ2 may be 180°<θ2<250° though it may vary depending on the operating conditions.

In the example of FIG. 6, the shape of the outer peripheral surface of the piston (45, 55) is determined such that the volume change rate is not lowered even if the rotation angle increases in the region A1. In addition, in the example of FIG. 6, the shape of the outer peripheral surface of the piston (45, 55) is determined such that the volume change rate is increased as the rotation angle increases in the region A1.

Reduction in Torque Ripple

In the compressor (10) according to the embodiment, reduction in variation of the compression torque (so-called torque ripple) is attempted. This will be described with reference to FIGS. 6 to 11.

In the compressor (10) according to the embodiment, the phase rotation angle of the first piston (45) is opposite to that of the second piston (55). This can smooth the compression torque in the entire compressor (10), reducing the range of variation in the compression torque.

The compression torque is proportional to the volume change rate and the internal pressure of the cylinder chamber. As indicated by the dash-dot-dot line in FIG. 9, the internal pressure of the compression chamber in the comparative example 1 is increased as the rotation angle increases and reaches the maximum value immediately before start of the discharge stroke. The volume change rate in comparative example 1 reaches the peak value at the rotation angle of 180° as indicated by the dash-dot-dot line in FIG. 6. The product of such an internal pressure and the volume change rate for every rotation angle indicates features of the variation in the compression torque.

Figure 8:
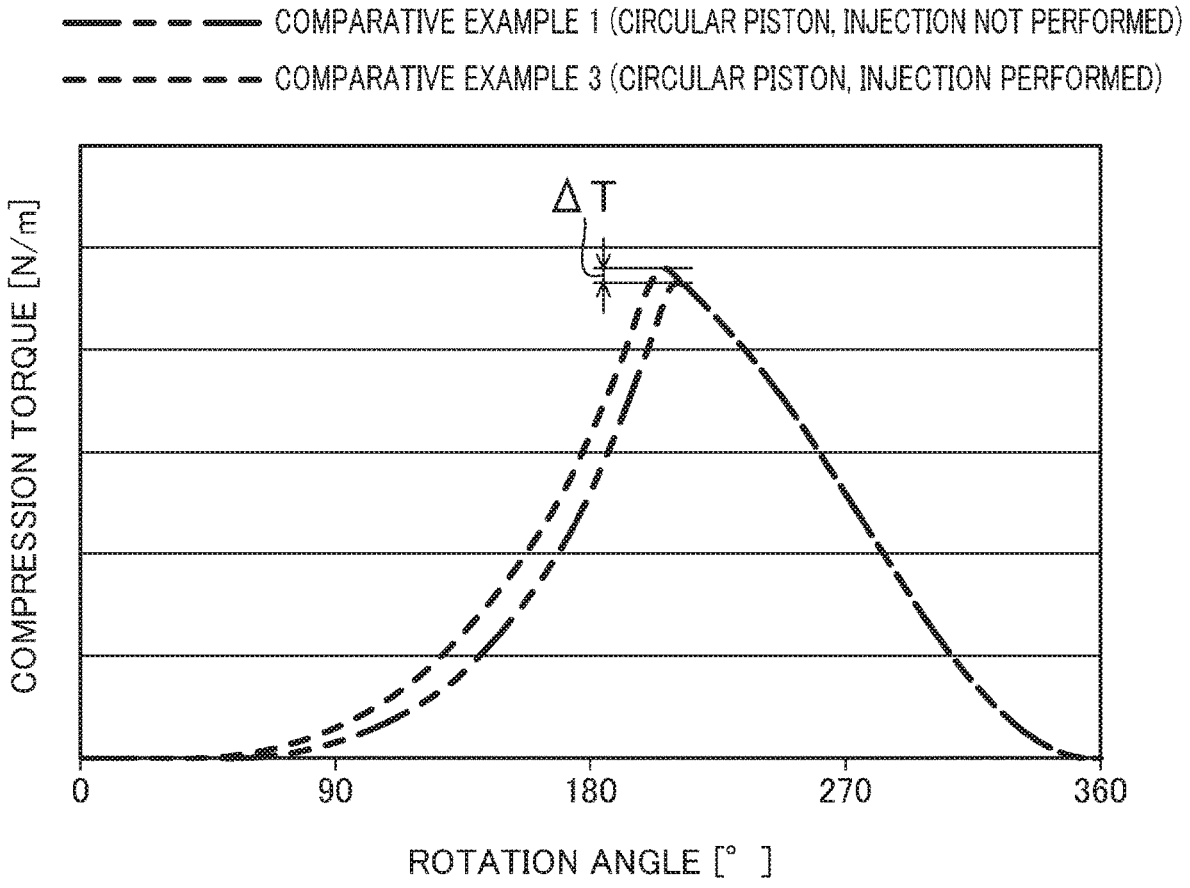
FIG. 8 is a graph making a comparison between the comparative examples 1 and 3 regarding the relationship between the rotation angle of the piston and the compression torque.

As indicated by the dash-dot-dot line in FIG. 8, a compression torque in the comparative example 1 (a compressor having a piston whose outer peripheral surface has a perfect circular shape) rises abruptly as the rotation angle increases, and reaches the peak value immediately before start of the discharge stroke. Thereafter, the compression torque falls abruptly as the rotation angle increases, and reaches almost zero when the rotation angle is 360°. Therefore, in the comparative example 1, when the drive shaft makes one rotation, the compression torque varies significantly.

In contrast, according to the embodiment, as shown in FIGS. 3 and 4, the phases of the rotation angles of the respective pistons (45, 55) of the compression units (41, 51) are shifted from each other by 180°. Therefore, synthetization of two types of compression torque in the two compression units (41, 51) (synthesized torque (see the solid line in FIG. 7)) are more smoothed than in the comparative example 1 in FIG. 8. This can reduce the range of variation in the compression torque in the entire compressor (10).

Figure 7:
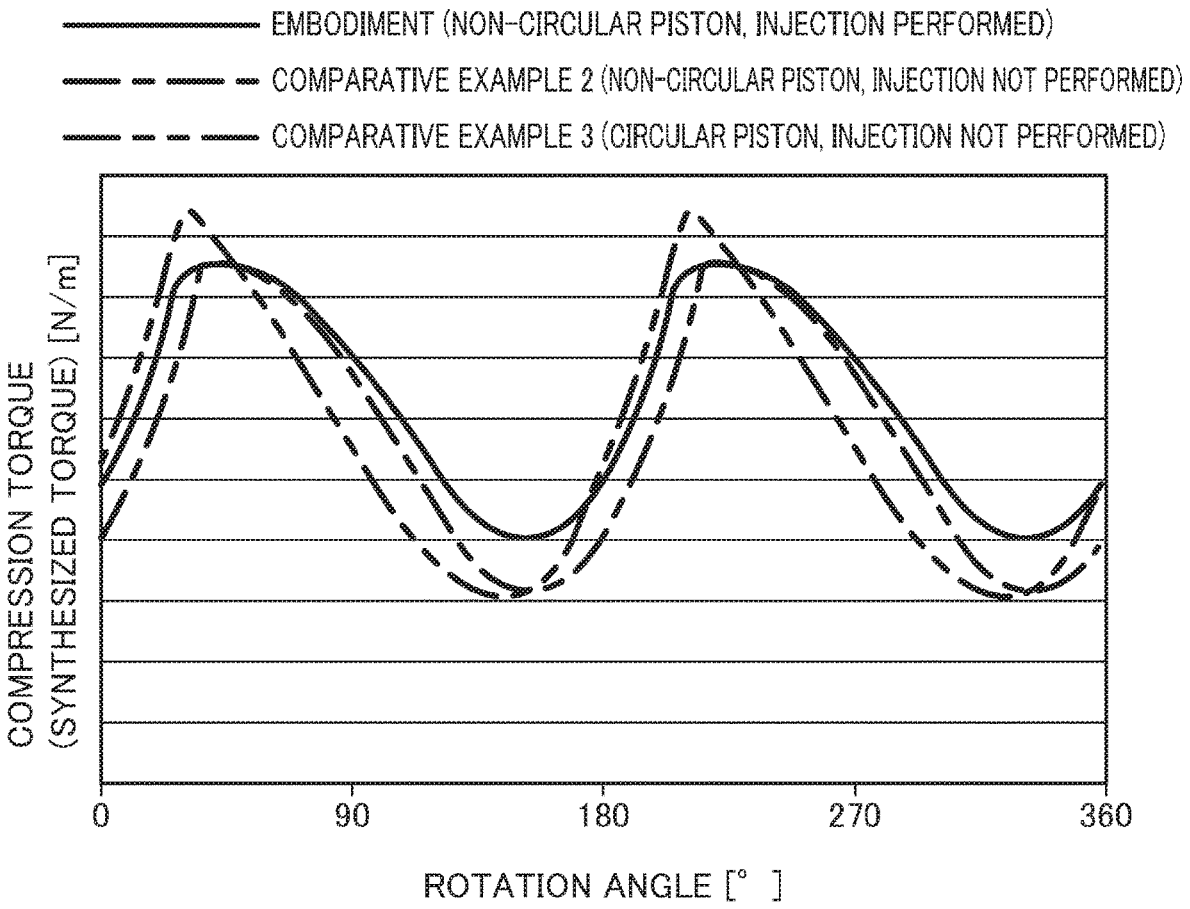
FIG. 7 is a graph making a comparison among the embodiment, a comparative example 2, and a comparative example 3 regarding the relationship between a compression torque (synthesized torque) and a rotation angle of the piston having a configuration in which phases of two pistons are opposite to each other.

In addition, in the compressor (10) according to the embodiment, the arcuate surface (the third arcuate surface (C3)) of the piston (45, 55) adjacent to the bottom dead center is gently arched. This can further reduce the range of variation in the compression torque. That is to say, as shown in FIG. 6, the volume change rate of the compression chamber (75) in this embodiment is relatively small when the rotation angle is approximately 180°. Therefore, the maximum value (peak) of the volume change rate at the rotation angle of around 180° is smaller in the embodiment than in the comparative example 1. Thus, as shown in FIG. 7, the peak value of the compression torque in the entire compressor (10) can be reduced, further reducing the range of variation in the compression torque.

Further, in the compressor (10) of the embodiment, the intermediate-pressure refrigerant is introduced into the compression chamber (75), still further reducing the range of variation in the compression torque. Specifically, in a compression unit having a non-circular piston same as or similar to the embodiment except that no intermediate-pressure refrigerant is introduced (i.e., a comparative example 2), the internal pressure in the cylinder chamber is changed as indicated by the one-dot-chain line of FIG. 11 and the compression torque is changed as indicated by the one-dot-chain line of FIG. 10. In contrast, just like the embodiment, if an intermediate-pressure refrigerant is introduced into each cylinder chamber (*), as indicated by the solid line of FIGS. 10 and 11, the timing of work of compression during the compression stroke in each cylinder chamber (*) is earlier, and the internal pressure is started to be increased at a smaller rotation angle than in the comparative example 2. Thus, the compression torque at the rotation angle of about 90° is larger in the embodiment than in the comparative example 2. Accordingly, as indicated by the solid line of FIG. 7, the maximum value of the synthesized torque in the compressor (10) of the embodiment can be increased because of introducing the intermediate-pressure refrigerant. The range of the synthesized torque can be more reduced in the embodiment than in the comparative example 2 in FIG. 7 (including two compression units which each have a non-circular piston but into which no intermediate-pressure refrigerant is introduced).

If an intermediate-pressure refrigerant is introduced in the compression units (41, 51) having the non-circular pistons (45, 55) just like the embodiment, the maximum value (the peak value) of the compression torque can be more effectively reduced than in a case where an intermediate-pressure refrigerant is introduced into the compression units having perfect circular pistons. This will be described in detail with reference to FIG. 6 and FIGS. 8 to 10.

Figure 9:
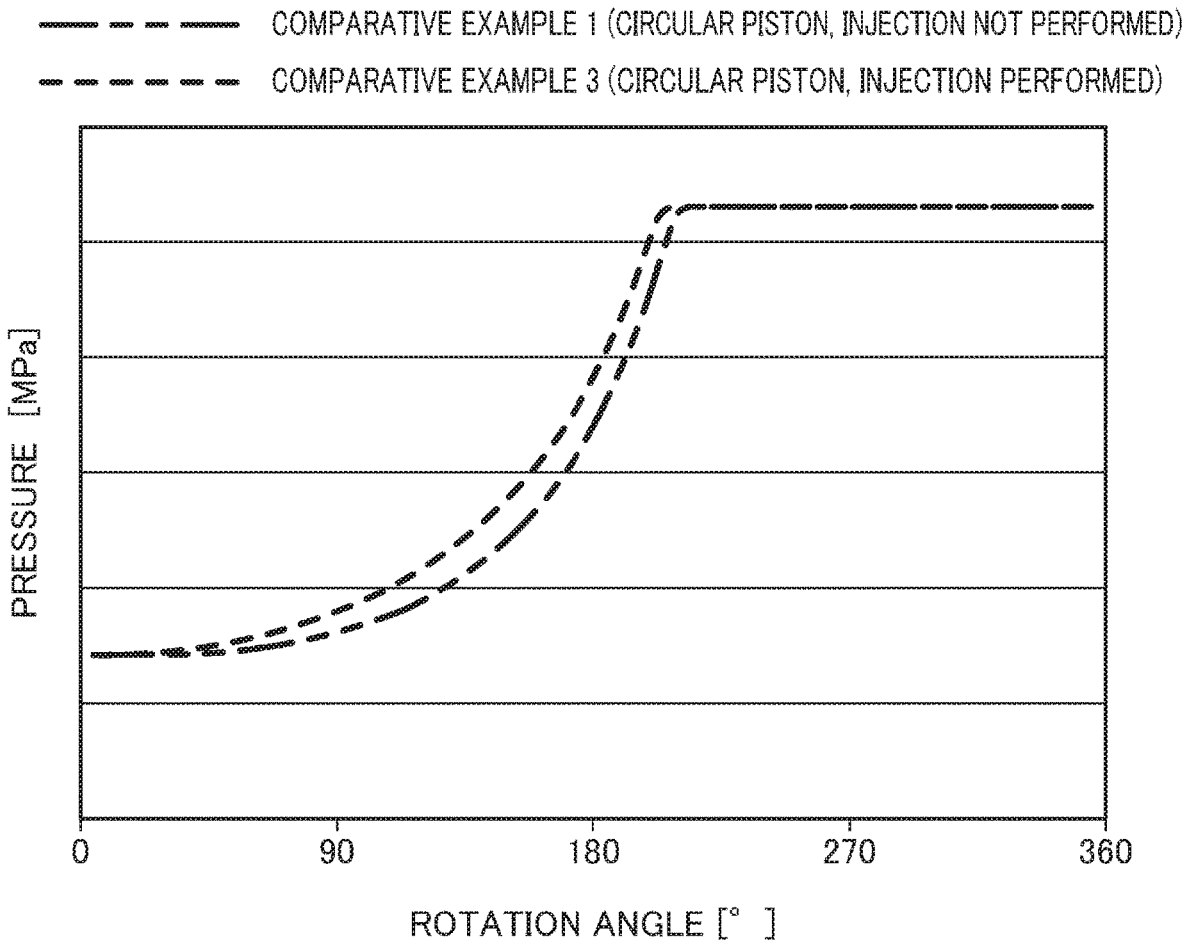
FIG. 9 is a graph making a comparison between the comparative examples 1 and 3 regarding the relationship between the rotation angle of the piston and an internal pressure (pressure) of a compression chamber.
Figure 10:
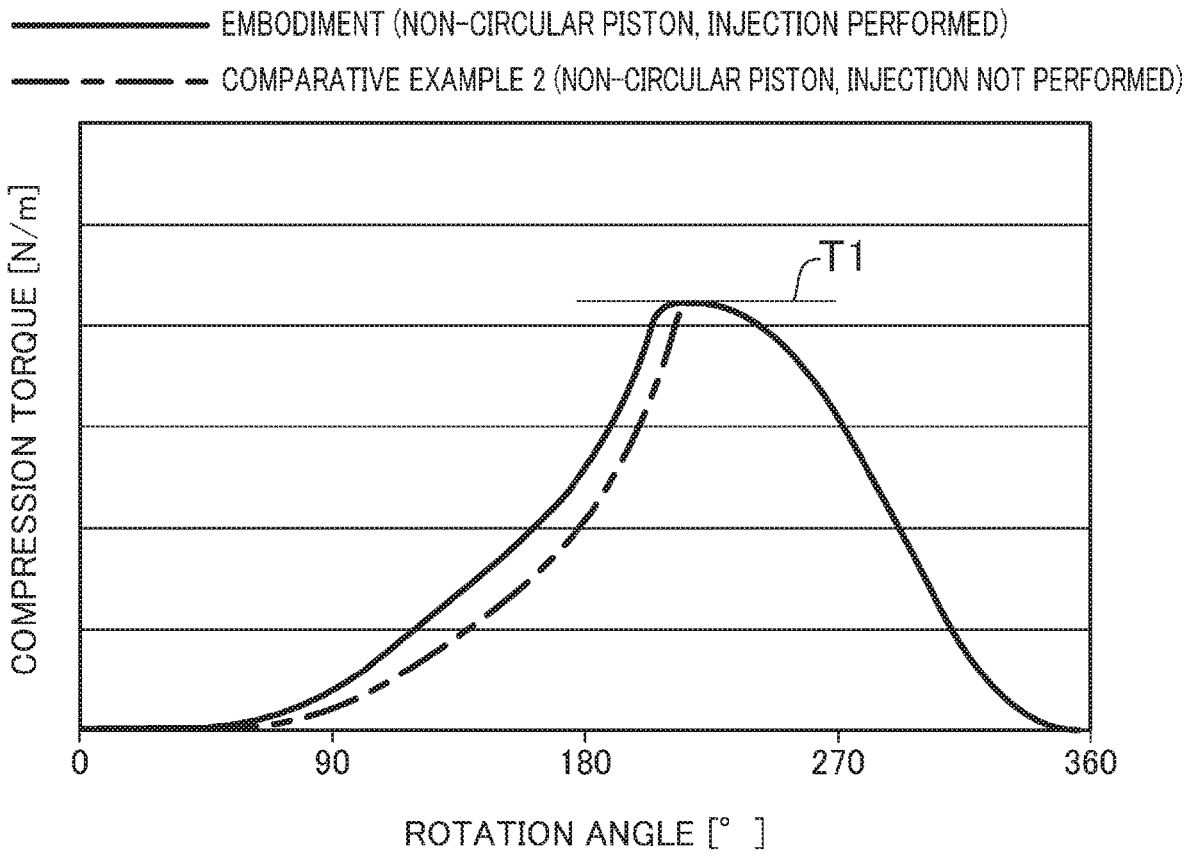
FIG. 10 is a graph making a comparison between the embodiment and the comparative example 2 regarding the relationship between the rotation angle of the piston and the compression torque.
Figure 11:
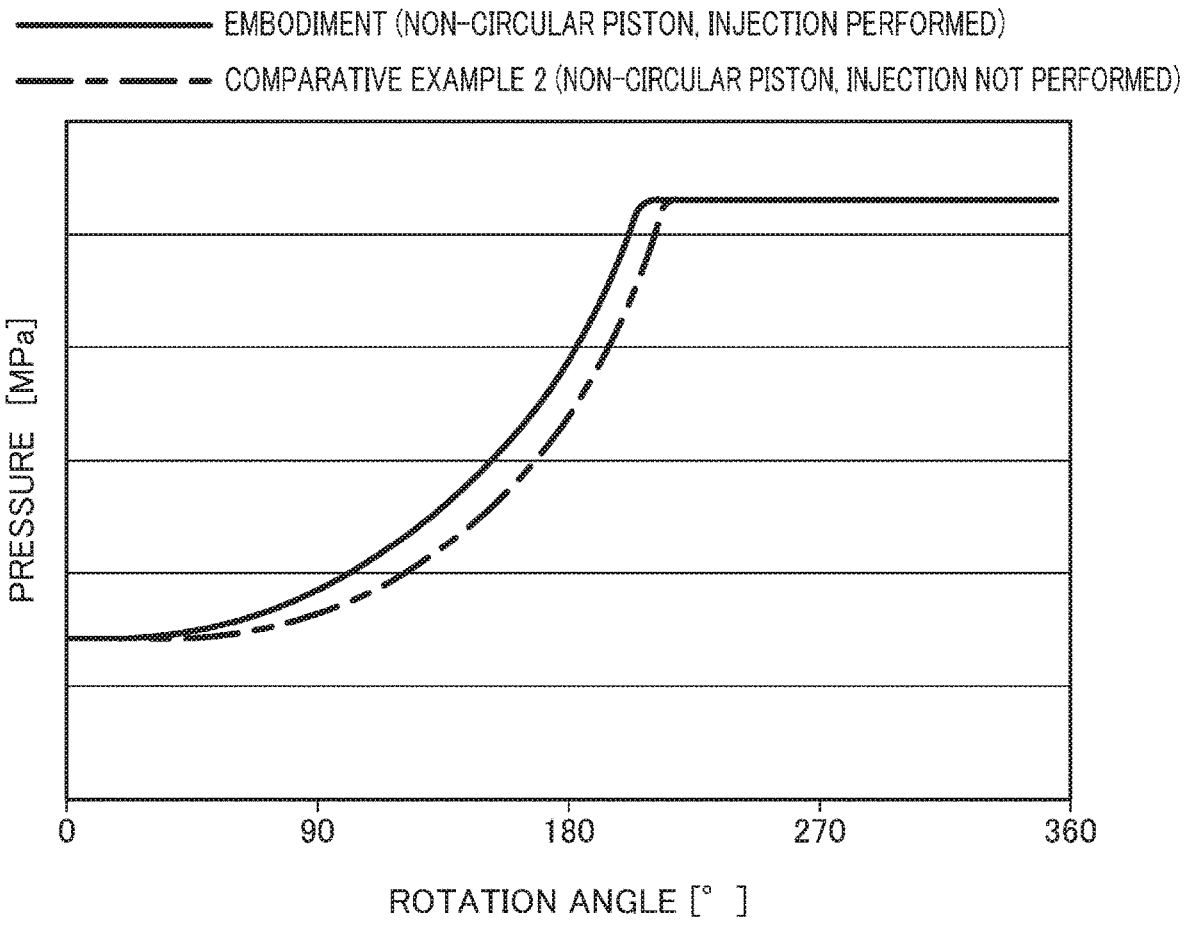
FIG. 11 is a graph making a comparison between the embodiment and the comparative example 2 regarding the relationship between the rotation angle of the piston and an internal pressure (pressure) of the compression chamber.

First, in the compressor having a piston whose outer peripheral surface has a perfect circular shape, the case where no intermediate-pressure refrigerant is introduced (the comparative example 1) is compared with the case where an intermediate-pressure refrigerant is introduced (the comparative example 3). As shown in FIGS. 8 and 9, introducing an intermediate-pressure refrigerant makes the timing of the work of compression earlier, making the timing of the start of the discharge stroke earlier. Therefore, the rotation angle at which the internal pressure of the cylinder chamber reaches the peak value is earlier (smaller) in the comparative example 3 than in the comparative example 1.

In the comparative example 1 (same as or similar to the comparative example 3 as shown in FIG. 6, the volume change rate is lowered as the rotation angle increases within a range from the rotation angle θ1 (for example, 180°) to the rotation angle θ2 at which the compression stroke is ended (within the region A1). Therefore, in a situation where the rotation angle at which the internal pressure of the cylinder chamber reaches the peak value is lowered due to introduction of an intermediate-pressure refrigerant, the volume change rate associated with this rotation angle is increased and hence, the compression torque at this rotation angle is increased. As a result, if an intermediate-pressure refrigerant is introduced into the compression unit having a perfect circular piston, as shown in ΔT of FIG. 8, the maximum value of the compression torque is increased, decreasing the effect of reducing the range of variation in the compression torque.

In contrast, just like the embodiment, introducing an intermediate-pressure refrigerant into the compressor (10) having the non-circular pistons (45, 55) can prevent the maximum value of the compression torque from increasing too much.

That is to say, in the embodiment (same as or similar to the comparative example 2), as shown in FIG. 6, even if the rotation angle is increased in the region A1, the volume change rate is not lowered, and rather is increased. In other words, in the embodiment and the comparative example 2, as the rotation angle decreases in the region A1, the volume change rate is lowed. Therefore, even if introducing intermediate-pressure refrigerant lowers the rotation angle at which the internal pressure in the cylinder chamber (*) reaches the peak value, neither the volume change rate nor the compression torque which are associated with this rotation angle is not increased. Therefore, in the embodiment, introduction of the intermediate-pressure refrigerant does not increase the maximum value of the compression torque (for example, T1 of FIG. 10). Accordingly, the configuration in the embodiment can effectively reduce the range of variation in the compression torque.

Advantages of Embodiment

In the embodiment, the third arcuate surface (C3) of the piston (45, 55) adjacent to the bottom dead center is more gently arched than the adjoining second arcuate surface (C2) and the adjoining fourth arcuate surface (C4). That is to say, in the piston (45, 55), the curvature radius (R3) of the third arcuate surface (C3) is larger than the curvature radius (R2) of the second arcuate surface (C2) and than the curvature radius (R4) of the fourth arcuate surface (C4). Therefore, the volume change rate when the piston (45, 55) passes through an area near the bottom dead center can be lowered, and hence, the maximum value of the compression torque can be reduced. At the same time, introducing the intermediate-pressure refrigerant into the compression chamber (75) can increase the minimum value of the compression torque. As a result, even under a condition where, e.g., the pressure differential in the refrigerant is relatively large, the range of variation in the compression torque can be effectively reduced, and vibration and noise can be reliably reduced.

As shown in FIG. 6, the piston (45, 55) is configured such that the volume change rate is not lowered in the range from θ1 to θ2. Thus, as shown in FIG. 8, such a configuration, even if an intermediate-pressure refrigerant is introduced into the compression chamber, can prevent the maximum value of the compression torque from increasing too much. In particular, in the embodiment, the volume change rate is increased in the range from θ1 to θ2, reliably preventing the maximum value of the compression torque from increasing too much.

Modification of Embodiment

Figure 12:
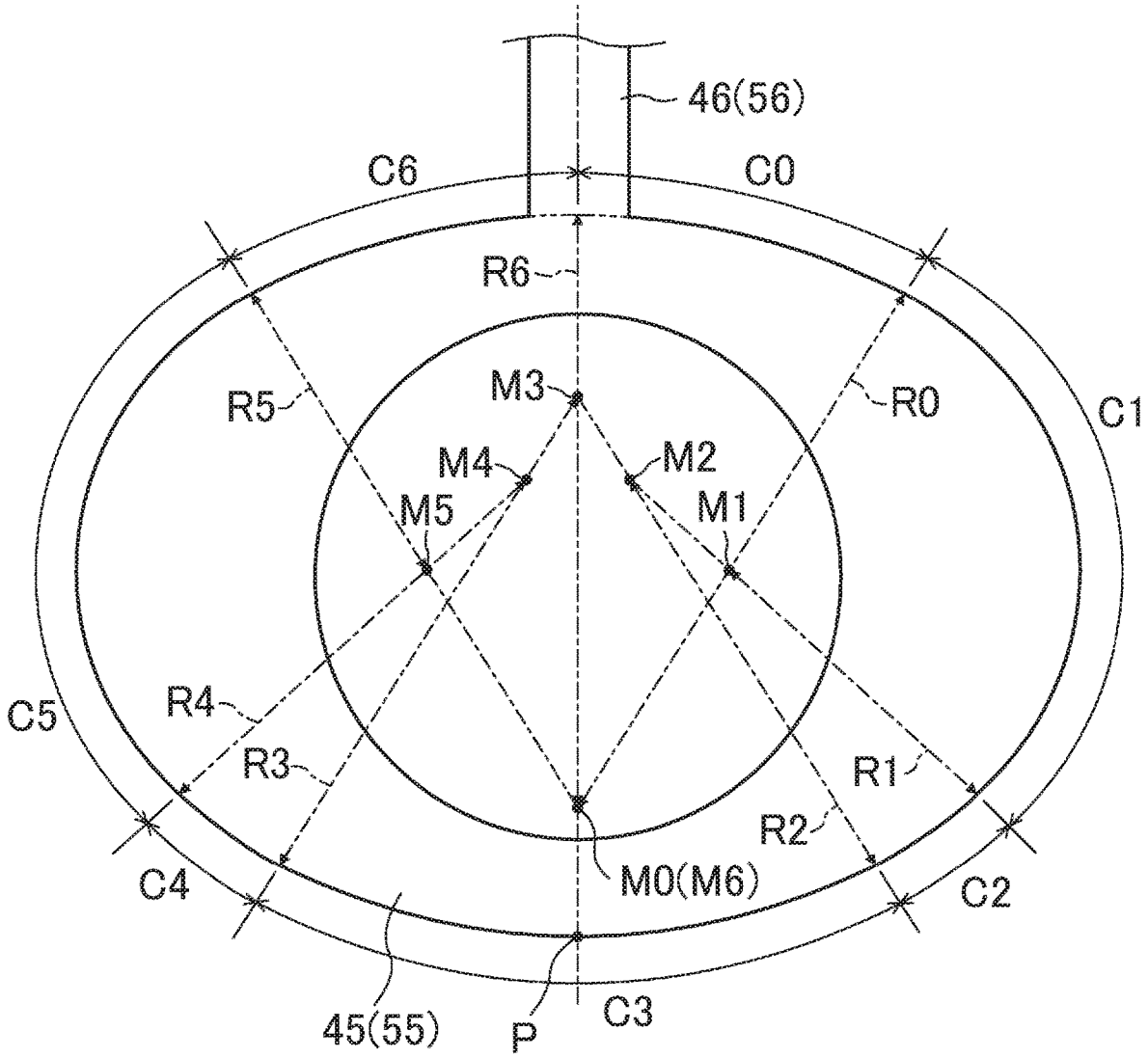
FIG. 12 is a plan view illustrating the shape of the outer peripheral surface of a piston according to a modification.

One modification shown in FIG. 12 is different from the embodiment in the shape of the pistons (45, 55). Just like the above-described embodiment, in this modification, the pistons (45, 55) each have a substantially elliptical shape or a substantially oval shape. The outer peripheral surface of the piston (45, 55) is shaped such that the arcuate surface (third arcuate surface (C3)) adjacent to the bottom dead center is more gently ached than other portions such as the second arcuate surface (C2) and the fourth arcuate surface (C4).

Specifically, in the modification, the curvature radius (R3) of the third arcuate surface (C3) is larger than the curvature radius (R2) of the second arcuate surface (C2) and than the curvature radius (R4) of the fourth arcuate surface (C4). The curvature radius (R2) of the second arcuate surface (C2) and the curvature radius (R4) of the fourth arcuate surface (C4) are larger than the curvature radius (R1) of the first arcuate surface (C1) and than the curvature radius (R5) of the fifth arcuate surface (C5). Such a configuration the volume change rate of the compression chamber (75) is sequentially "rather steeply," "rather mildly," "mildly," "rather mildly," and then, "rather steeply" changed.

Figure 13:
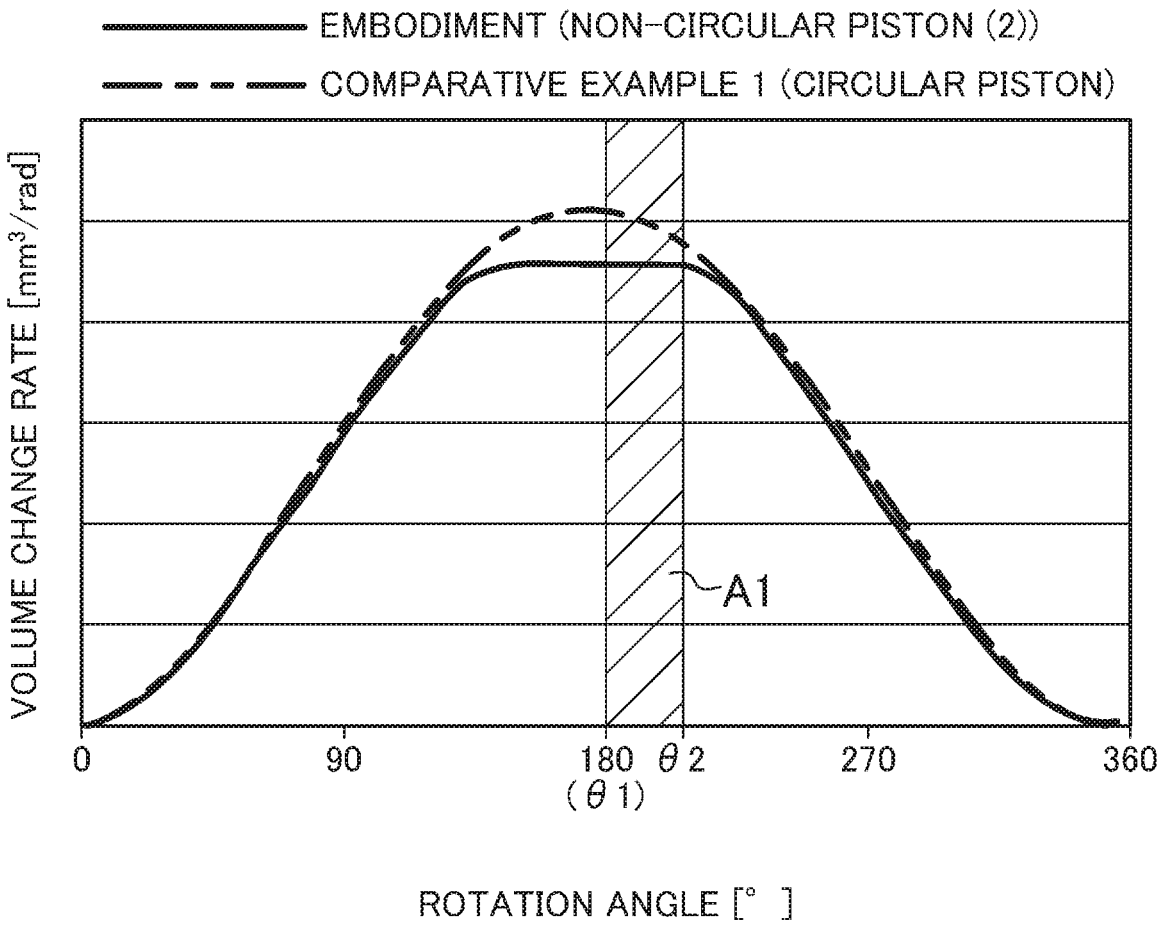
FIG. 13 is a graph making a comparison between a modification and a comparative example 1 regarding e relationship between the rotation angle of the piston and the volume change rate.

As shown in FIG. 13, the volume change rate in the phase period near the bottom dead center is smaller in the modification than in the comparative example 1, and is generally constant. That is to say, in the modification, the volume change rate in the region A1 ranging from the rotation angle θ1 (for example, the rotation angle 180°) to the rotation angle θ2 (180°<θ2<250°) at which the compression is ended is not lowered, acid is constant. In this configuration, introducing the intermediate-pressure refrigerant into the compression chamber (75) can also prevent the maximum value of the compression torque from increasing too much.

Other advantages are the same as or similar to those in the embodiment.

Other Embodiments

Figure 5:
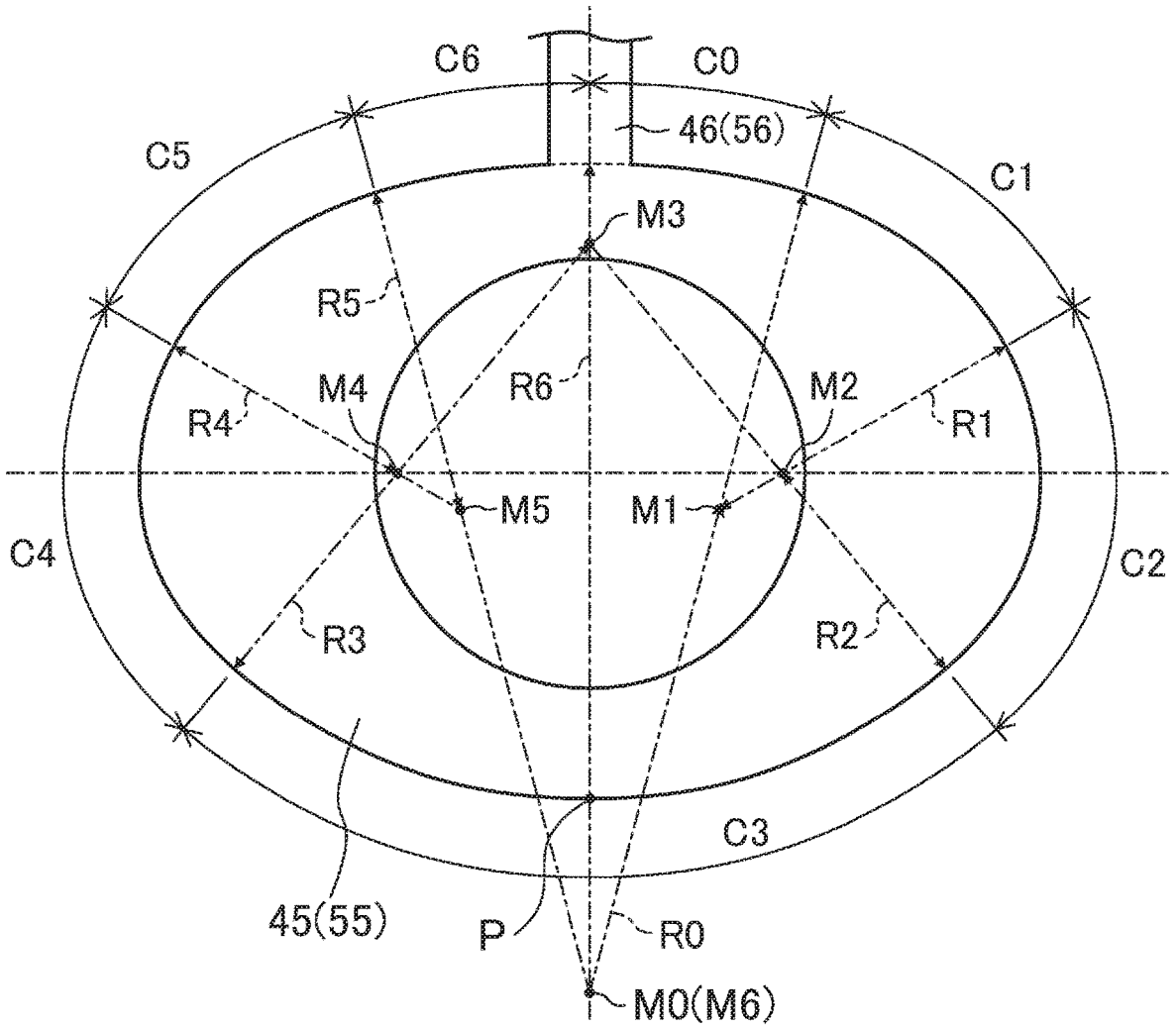
FIG. 5 is a plan view illustrating the shape of the outer peripheral surface of the piston according to the embodiment.

A piston having a shape different from the pistons (45, 55) exemplified in FIGS. 5 and 12 may be adopted as long as the volume change rate near the bottom dead center can be more reduced than the circular piston (the comparative example 1 in FIG. 6). In this case, it is preferable that the piston (45, 55) has a shape such that the volume change rate is not lowered in, in particular, the region A1 ranging from the rotation angle θ1 to θ2. Further, the angle θ1 may preferably be 180°. The angle θ2 may preferably be 180°<θ2<250°, and may more preferably be 220°.

Other Modifications of Embodiment

Another Modification 1

Another Modification 1 has the same configuration as the embodiment, except the mechanism for performing an injection operation.

The compression mechanism (40) includes an injection mechanism (160) configured to perform an injection operation in each compression unit (41, 51). The configuration of the injection mechanism (160) will be described with reference to FIGS. 14 to 16. The injection mechanism (160) includes an introduction passage (161) configured to introduce an intermediate-pressure fluid into each cylinder chamber (60,70) (precisely, into the compression chamber (75)), and an opening/closing mechanism (170) configured to open/close the introduction passage (161). The introduction passage (161) and the opening/closing mechanism (170) in this modification are provided to the middle plate (44).

The introduction passage (161) includes a main introduction passage (162) extending inward from the outer periphery of the middle plate (44), and two dividing passages (163, 164) dividing from terminal ends of the main introduction passage (162).

The main introduction passage (162) extends along a tangential line of the inner peripheral surface of the through hole (44*a*) so as not to interfere with the through hole (44*a*) of the middle plate (44). The terminal end of the main introduction passage (162) is disposed in the two cylinder chambers (60, 70) at a position adjacent to the discharge port. The main introduction passage (162) includes a large diameter passage (165) and a small diameter passage (166). The large diameter passage (165) is an upstream passage of the main introduction passage (165). The introduction pipe (28) is inserted into the large diameter passage (165). The small diameter passage (166) is a downstream passage of the main introduction passage (165). The small diameter passage (166) communicates with the two dividing passages (163, 164). The small diameter passage (166) is coaxial with the large diameter passage (165), and has a smaller diameter than the large diameter passage (165).

A valve guard (167) is fitted into a portion connecting the large diameter passage (165) and the small diameter passage (166) together. The valve guard (167) is flat annular-shaped and is coaxial with the main introduction passage (162) to allow the large diameter passage (165) to communicate with the small diameter passage (166). The valve guard (167) has a cylindrically shaped, large diameter portion (168) and a cylindrically shaped, small diameter portion (169) having a smaller diameter than the large diameter portion (168). The large diameter portion (168) is fitted into the terminal end of the large diameter passage (165), and the small diameter portion (169) is fitted into the starting end of the small diameter passage (166). The tip end surface of the small diameter portion (169) constitutes a contact surface in contact with the valve body (171) in the closed state.

The two dividing passages (163, 164) are a first dividing passage (163) communicating the first cylinder chamber (60) and a second dividing passage (164) communicating with the second cylinder chamber (70). The first dividing passage (163) extends upward from the small diameter passage (166) toward the first cylinder chamber (60). The second dividing passage (164) extends downward from the small diameter passage (166) toward the second cylinder chamber (70). The dividing passages (163, 164) are cylindrically shaped and each have an axial center extending vertically.

Figure 14:
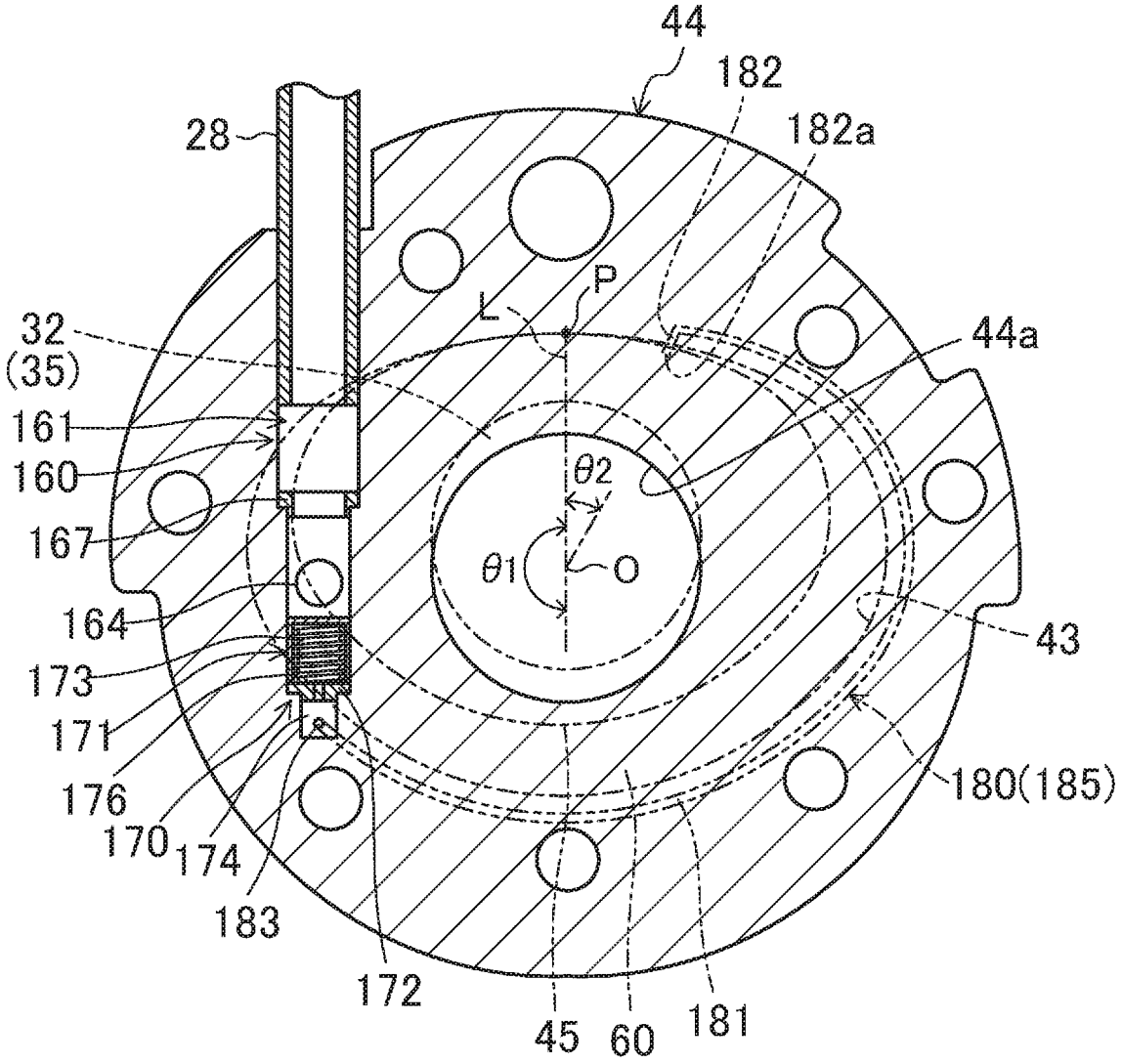
FIG. 14 is a horizontal cross-sectional view of a middle plate.
Figure 15:
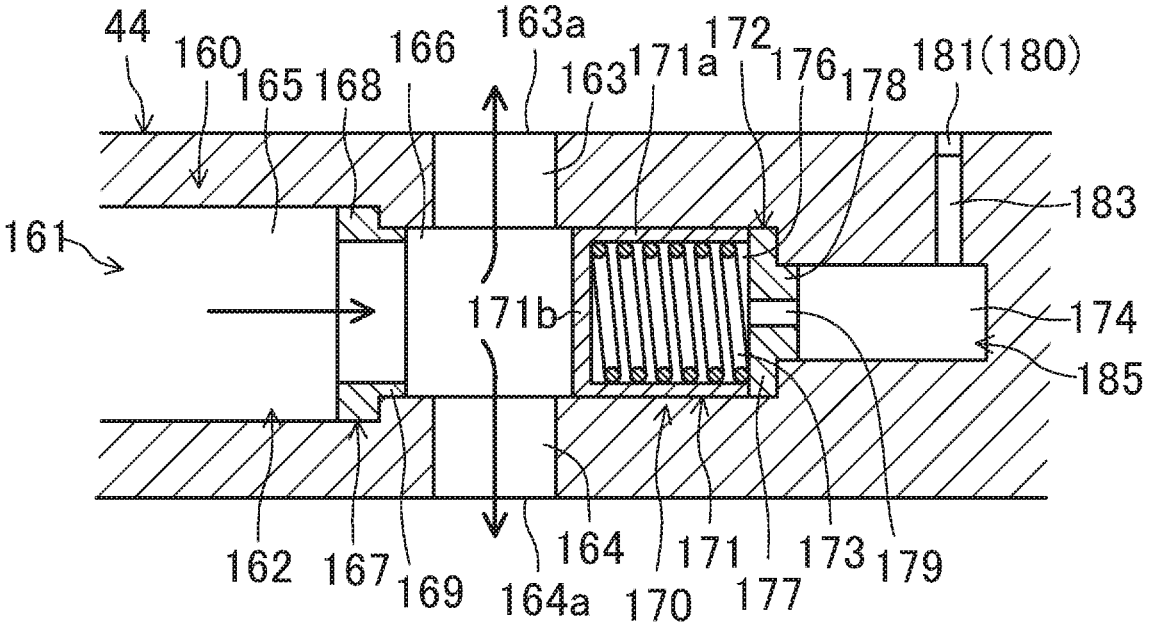
FIG. 15 is a vertical sectional view of an injection mechanism of a compressor according to another modification 1, and shows a state where a valve body is opened.

The terminal end of the first dividing passage (163) constitutes an opening surface (a first injection port (163*a*) (a first introduction section)) opening to the first cylinder chamber (60) (see FIG. 15). The terminal end of the second dividing passage (164) constitutes an opening surface (a second injection port (164*a*) (a second introduction section)) opening to the second cylinder chamber (70). The injection ports (163*a*, 164*a*) may be provided within the range of the angle θ1 in the respective cylinder chambers (60, 70). It is preferable that, if the line L in FIG. 14 is supposed to be a reference, the range of the angle θ1 is in the range from 180° to 360° in the clockwise direction with the center of the cylinder chamber (60, 70) as O. The line L is an imaginary plane linking the center O of the cylinder chambers (60, 70)

to the sealing point P in a situation where the pistons (45, 55) are positioned at the top dead center.

The opening/closing mechanism (170) includes the valve body (171), a valve seat (172), a spring (173), a relay space (174), and a communication groove (180).

The valve body (171) is disposed inside a valve housing (175). The valve housing (175) is configured as a cylindrical inner peripheral surface ranging from the valve guard (167) to the valve seat (172). The valve body (171) has a cylindrical portion (171*a*) and a closing portion (171*b*). The cylindrical portion (171*a*) is cylindrically shaped along the wall surface of the valve housing (175). The closing portion (171*b*) closes an axial end of the cylindrical portion (171*a*) closer to the valve guard (167). The closing portion (171*b*) is in contact with the valve guard (167) when the valve body (171) is in the closed state.

A back pressure chamber (176) is defined in the interior of the valve body (171). That is to say, the valve body (171) divides the introduction passage (161) from the back pressure chamber (176). The pressure of the refrigerant (low pressure) introduced from the communication groove (180) is applied to the back pressure chamber (176). The internal portion of the valve body (171) also constitutes a housing space for housing the spring (173).

The valve body (171) is configured so as to reciprocate between a position where the introduction passage (161) is opened (the position shown in FIG. 15) and a position where the introduction passage (161) is closed (the position shown in FIG. 16) in accordance with the pressure differential between the introduction passage (161) and the back pressure chamber (176). Specifically, when the valve body (171) is closed, the closing portion (171*b*) is in contact with the valve guard (167), and at the same time, the respective inlets of the first dividing passage (163) and the second dividing passage (164) close the cylindrical portion (171*a*). When the valve body (171) is opened, the respective inlets of the first dividing passage (163) and the second dividing passage (164) are exposed, allowing the dividing passages (163, 164) to communicate with the main introduction passage (162).

The valve seat (172) is held by a step provided between the valve body (171) and the relay space (174). The valve seat (172) is formed in a cylindrical shape having a step on its outer peripheral surface. The valve seat (172) has a large diameter valve seat (177) and a small diameter valve seat (178) which are coaxial with each other. The large diameter valve seat (177) has a contact surface in contact with the valve body (171) and the spring (173). The small diameter valve seat (178) faces the relay space (174). A communication hole (179) of which the axial center is coaxial with the axial center of the valve seat (172) is formed inside the valve seat (172). The communication hole (179) allows the back pressure chamber (176) to communicate with the relay space (174).

The spring (173) is disposed between the valve body (171) and the valve seat (172). The spring (173) has a biasing portion biasing the valve body (171) toward the valve guard (167). The spring (173) has one end abutting on the closing portion (171*b*) of the valve body (171). The spring (173) has the other end abutting on the large diameter valve seat (177) of the valve seat (172).

The relay space (174) is configured as a cylindrically space coaxial with the introduction passage (161). The relay space (174) has a smaller diameter than the introduction passage (161).

The communication groove (180) is a passage allowing the suction chamber (74) to communicate with the back pressure chamber (176). The communication groove (180) is formed in an axial end surface of the middle plate (44). The communication groove (180) in this modification is formed in an axial end surface of the middle plate (44) (the upper surface), the surface facing the first cylinder chamber (60). The communication groove (180) includes an arcuate groove (181) positioned radially outward of first cylinder chamber (60), and a transverse groove (182) extending radially inward from one end of the arcuate groove (181).

The arcuate groove (181) is arc-shaped so as to be along the inner peripheral surface of the first cylinder chamber (60). The curvature radius of the arcuate groove (181) is larger than that of the first cylinder chamber (60). The inner peripheral surface of the first cylinder chamber (60) and the arcuate groove (181) are parallel to each other when viewed along the axial direction as shown in FIGS. 4 and 5. The upper opening of the arcuate groove (181) is closed by the lower surface of the first cylinder (43).

The starting end of the arcuate groove (181) is disposed adjacent to the suction chamber (74) and the first suction port (63) in the first cylinder chamber (60). The terminal end of the arcuate groove (181) is disposed at a position corresponding to the third quadrant with the line L of FIG. 14 as a reference. The terminal end of the arcuate groove (181) is disposed at a position where it overlaps with the relay space (174) in the axial direction (the vertical direction). The terminal end of the arcuate groove (181) and the relay space (174) communicate with each other via a vertical hole (183) extending vertically.

The radially outer end of the transverse groove (182) is connected to the starting end of the arcuate groove (181). The radially inner end of the transverse groove (182) is disposed radially inward of the inner peripheral surface of the first cylinder chamber (60). That is to say, the radially inner end of the transverse groove (182) communicates with the suction chamber (74) of the first cylinder chamber (60).

An opening surface of the transverse groove (182) opening to the suction chamber (74) constitutes an introduction port (182*a*). The introduction port (182*a*) may be disposed in the range of the angle θ2 in the corresponding cylinder chamber (60, 70). The range of the angle θ2 may be preferably in the range from 0° to 30° in the clockwise direction with the line L as a reference.

The communication hole (179), the relay space (174), the vertical hole (183), the communication groove (180), the transverse groove (182), and the introduction port (182*a*) constitute a communication passage (185) configured to apply a low pressure to the back pressure chamber.

Injection Operation

In the refrigeration cycle in the refrigerant circuit, the injection operation is performed as appropriate during, e.g., a cooling operation. When the injection operation is performed, an intermediate-pressure refrigerant is introduced into the introduction pipe (28) of the compressor (10).

In the injection mechanism (160), the back pressure chamber (176) that is the back surface side of the valve body (171) communicates with the suction chamber (74) of the first cylinder chamber (60) through the communication passage (185). Specifically, the back pressure chamber (176) communicates with the suction chamber (74) of the first cylinder chamber (60) through the communication hole (179), the relay space 174), the vertical hole (183), the communication groove (180), the transverse groove (182), and the introduction port (182*a*). This makes the pressure of the back pressure chamber (176) substantially equal to the suction pressure (low pressure) of the refrigerant circuit.

Figure 16:
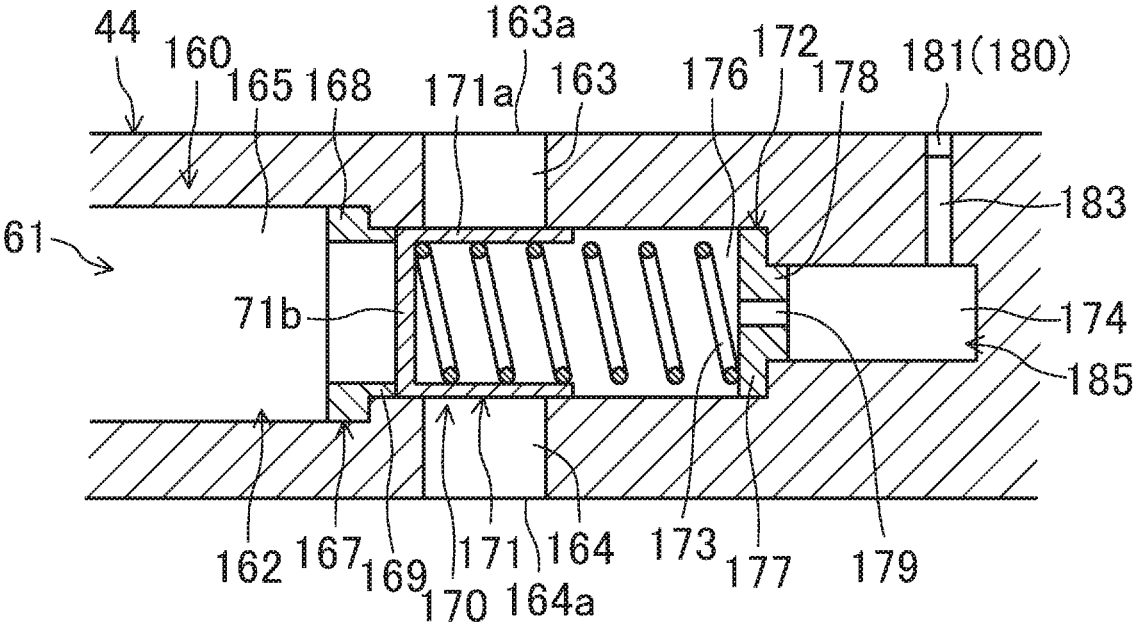
FIG. 16 is a vertical sectional view of the injection mechanism, and shows a state where the valve body is closed.

On the other hand, if an intermediate-pressure refrigerant is introduced into the introduction pipe (28), the pressure of the introduction passage (161) also becomes intermediate. As a result, the pressure differential ΔP between the introduction passage (161) and the back pressure chamber (176) is relatively large, and the valve body (171) shown in FIG. 16 is moved toward the valve seat (172) against the biasing force of the spring (173). As a result, as shown in FIG. 15, the valve body (171) is in contact with the valve seat (172), allowing the first dividing passage (163) and the second dividing passage (164) to communicate with the main introduction passage (162) In this state, the intermediate-pressure refrigerant flowing in the main introduction passage (162) diverges into the first dividing passage (163) and the second dividing passage (164). The refrigerant flowing through the first dividing passage (163) is introduced into the compression chamber (75) of the first cylinder chamber (60) in the course of compression through the first injection port (163*a*). The refrigerant flowing through the second dividing passage (164) is introduced into the compression chamber (75) of the second cylinder chamber (70) in the course of compression through the second injection port (164*a*).

In order to stop the injection operation, the introduction pipe (28) communicates with the suction line (suction pipe (26, 27)) of the compressor (10). As a result, the pressure of the introduction passage (161) becomes substantially equal to the suction pressure (low pressure) of the compressor (10). Then, the pressure differential ΔP between the introduction passage (161) and the back pressure chamber (176) is reduced, and the valve body (171) shown in FIG. 15 is moved toward the valve guard (167) by the biasing force of the spring (173). As a result, as shown in FIG. 16, the valve body (171) is in contact with the valve guard (167), closing the first dividing passage (163) and the second dividing passage (164). As a result, no intermediate-pressure refrigerant is introduced into each compression chamber (75).

Advantages of Modification 1

According to the modification 1, the communication groove (180) constitutes a part of the communication passage (185) for introducing the low pressure refrigerant into the back surface side of the valve body (171). The communication groove (180) can be formed easily by forming a groove in the axial end surface (the upper surface) of the middle plate (44). This can simplify the configuration of the communication passage (185) and reduce the cost for forming the configuration.

The injection mechanism (160) applies the pressure of the suction chamber (74) of the first cylinder chamber (60) to the back pressure chamber (176). Therefore, according to the difference between the low pressure and the intermediate pressure of the refrigerant, the valve body (171) can reliably be driven between the opened position and the closed position. As a result, switching of the injection operation can be performed, reliably.

In the injection mechanism (160), the introduction passage (161), the valve body (171), and the communication passage (185) are provided to the middle plate (44). This can provide an enough space for arranging the introduction passage (161), the valve body (171), and the communication passage (185) with no interference with the cylinder chamber (60, 70). The respective passages for constituting the communication passage (185) are completely connected together in the interior of the middle plate (44), further simplifying the injection mechanism (160).

The communication groove (180) is shaped so as to be along the inner peripheral surfaces of the cylinder chambers (60, 70). That is to say, the communication groove (180) is arc-shaped as if a portion of an elliptical or oval circle closer to the discharge side was cut off. In the middle plate (44), at least a part of the opening/closing mechanism (170) is disposed in a portion axially overlapping with a bulging portion of the cylinder chamber (60, 70) closer to the discharge side. This can provide an enough space for disposing the opening/closing mechanism (170).

Another Modification 2

In another modification 1, the communication groove (180) is formed in the upper surface of the middle plate (44), allowing the suction chamber (74) of the first cylinder chamber (60) to communicate with the back pressure chamber (176) through the communication groove (180). However, the communication groove (180) may be formed in the lower surface of the middle plate (44), allowing the suction chamber (74) of the second cylinder chamber (70) to communicate with the back pressure chamber (176) through the communication groove (180).

Also, the front head (42) constituting the closing member may be provided with the introduction passage (161) and the opening/closing mechanism (170). In this case, the communication groove (180) is formed on the lower surface of the front head (42), allowing the hack pressure chamber (176) formed inside the front head (42) to communicate with the suction chamber (74) of the first cylinder chamber (60) through the communication groove (180).

The rear head (52) constituting the opening/closing member may be provided with the introduction passage (161) and the opening/closing mechanism (170). In this case, the communication groove (180) is formed in the upper surface of the rear head (52), allowing the back pressure chamber (176) formed inside the rear head (52) to communicate with the suction chamber (74) of the second cylinder chamber (70) through the communication groove (180).

Another Modification 3

Figure 17:
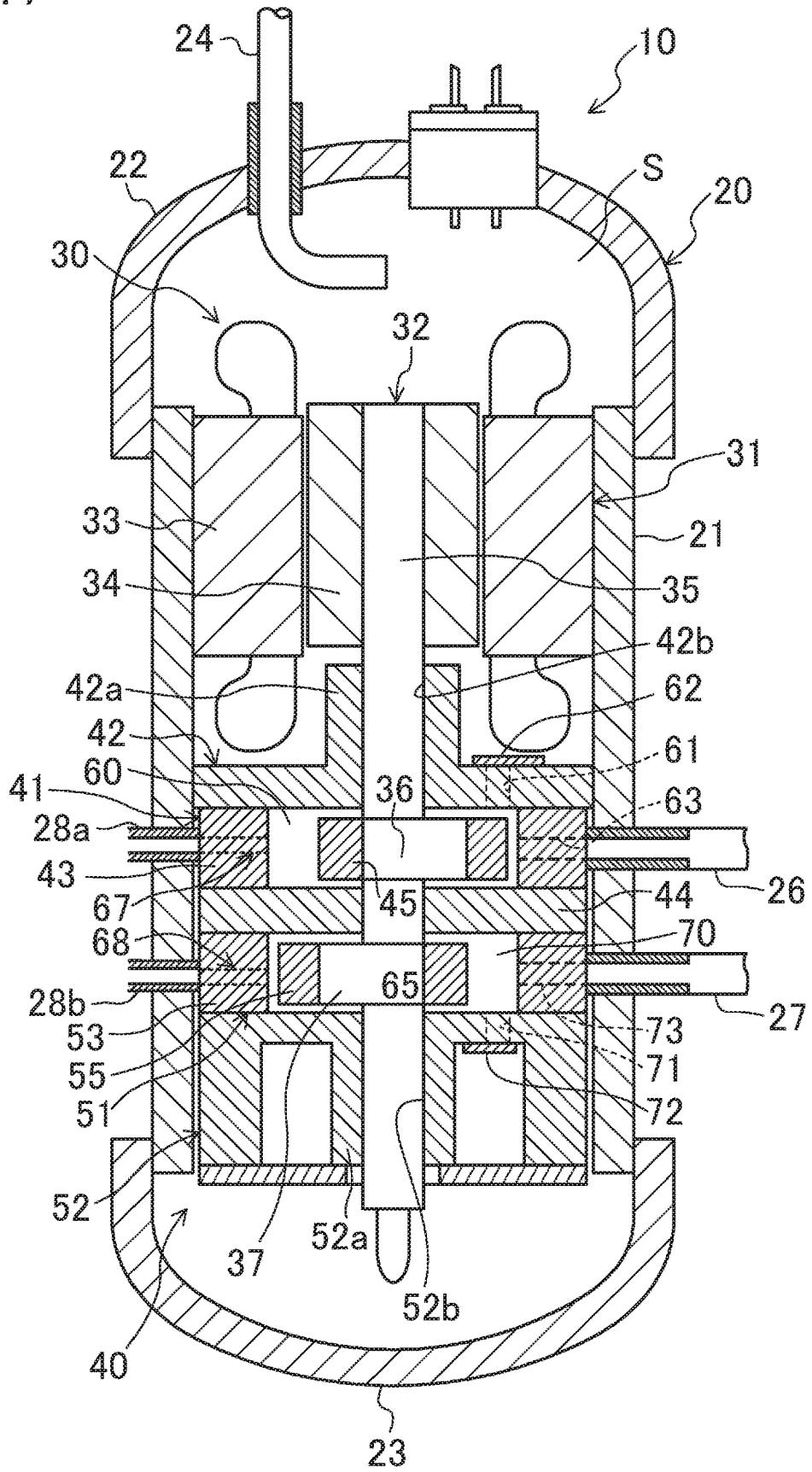
FIG. 17 is a vertical cross-sectional view of a compressor according to another modification 3.

Another Modification 3 shown in FIG. 17 is configured by providing the configuration of the embodiment with two introduction pipes (28*a*, 28*b*) associated with the cylinders (43, 53). That is to say, the configuration of the modification 3 includes a first introduction pipe (28*a*) associated with the first cylinder (43) and a second introduction pipe (28*b*) associated with the second cylinder (53). The first introduction pipe (28*a*) communicates with the first cylinder chamber (60) through the passage (the first introduction section (67)) radially passing through the first cylinder (43). The second introduction pipe (28*b*) communicates with the second cylinder chamber (70) through the passage (the second introduction section 68)) associated with the second cylinder (53). The intermediate-pressure refrigerant passing through the first introduction pipe (28*a*) is sent to the compression chamber (75) of the first cylinder chamber (60), and the intermediate-pressure refrigerant passing through the second introduction pipe (28*b*) is sent to the compression chamber (75) of the second cylinder chamber (70).

INDUSTRIAL APPLICABILITY

As can be seen from the foregoing description, the present disclosure is useful as an oscillating piston-type compressor.

The invention claimed is:

1. An oscillating piston compressor comprising:

two oscillating compression units, each compression unit having a cylinder forming a cylinder chamber, a bush hole being formed in the cylinder, a piston housed in the cylinder chamber, and a blade integrally formed with the piston, the piston rotating in the cylinder chamber through a rotation angle while the blade oscillates within the bush hole, and the rotation angle being zero degrees when the piston is nearest the bush hole; and an introduction port configured to introduce a refrigerant into a compression chamber of each of the compression units, the two compression units being configured such that phases of the pistons are opposite to each other, each of the pistons having a non-circular outer peripheral surface, and each of the cylinder chambers having an inner peripheral surface with a shape determined based on an envelope of the outer peripheral surface of the respective piston in rotation, when a compression stroke in each of the compression units is ended at a rotation angle θ2 under an operating condition in which the introduction port introduces no refrigerant into the cylinder chamber, the outer peripheral surface of the piston is shaped such that a volume change rate of the compression chamber is not decreased in a range from a rotation angle θ1 to the rotation angle θ2, and the rotation angle θ1 is smaller than the rotation angle θ2 by a predetermined angle, and the outer peripheral surface of the piston being shaped such that the volume change rate of the compression chamber is increased in the range.

2. The oscillating piston-type compressor of claim 1, wherein the rotation angle θ1 is 180°.

3. The oscillating piston-type compressor of claim 2, wherein the compression units each include a closing member closing an axial opening surface of a respective cylinder chamber, the oscillating piston-type compressor further comprises:

an introduction passage configured to introduce an intermediate-pressure fluid into each of the cylinder chambers; and an opening and closing mechanism configured to open and close the introduction passage, the opening and closing mechanism having a valve body driven to open and close the introduction passage, and a communication passage applying a predetermined pressure to a back pressure chamber adjacent to a back surface of the valve body, the opening and closing mechanism being configured to drive the valve body according to a pressure differential between the introduction passage and the back pressure chamber, and the communication passage including a communication groove formed in an axial end surface of each of the cylinders, an axial end surface of a middle plate disposed axially between the closing members, or an axial end surface of one of the closing members so as to be positioned adjacent to an outer periphery of each of the cylinder chambers.

4. The oscillating piston-type compressor of claim 1, wherein the compression units each include a closing member closing an axial opening surface of a respective cylinder chamber, the oscillating piston-type compressor further comprises:

an introduction passage configured to introduce an intermediate-pressure fluid into each of the cylinder chambers; and an opening and closing mechanism configured to open and close the introduction passage, the opening and closing mechanism having a valve body driven to open and close the introduction passage, and a communication passage applying a predetermined pressure to a back pressure chamber adjacent to a back surface of the valve body, the opening and closing mechanism being configured to drive the valve body according to a pressure differential between the introduction passage and the back pressure chamber, and the communication passage including a communication groove formed in an axial end surface of each of the cylinders, an axial end surface of a middle plate disposed axially between the closing members, or an axial end surface of one of the closing members so as to be positioned adjacent to an outer periphery of each of the cylinder chambers.

5. The oscillating piston-type compressor of claim 4, wherein the communication passage allows the back pressure chamber to communicate with a suction chamber of each of the cylinder chambers.

6. The oscillating piston-type compressor of claim 5, wherein the introduction passage and the valve body are disposed inside the one of the closing members.

7. The oscillating piston-type compressor of claim 5, wherein the introduction passage and the valve body are disposed inside the middle plate.

8. The oscillating piston-type compressor of claim 7, wherein the communication groove is formed in an end surface of the middle plate.

9. The oscillating piston-type compressor of claim 4, wherein the introduction passage and the valve body are disposed inside the one of the closing members.

10. The oscillating piston-type compressor of claim 9, wherein the communication groove is formed in an end surface of the one of the closing members.

11. The oscillating piston-type compressor of claim 4, wherein the introduction passage and the valve body are disposed inside the middle plate.

* * * * *